US005178080A

United States Patent [19]

Nomura et al.

[11] Patent Number: 5,178,080

[45] Date of Patent: Jan. 12, 1993

[54] FABRIC POSITION CORRECTING DEVICE

[75] Inventors: Etsuzo Nomura, Kasugai; Kohichi Akahane, Komaki; Hirosumi Ito, Nagoya; Hirokazu Takeuchi, Aichi, all of Japan

[73] Assignee: Brother Kogyo Kabushiki Kaisha, Nagoya, Japan

[21] Appl. No.: 831,505

[22] Filed: Feb. 4, 1992

[30] Foreign Application Priority Data

| | | | |
|---|---|---|---|
| Feb. 8, 1991 | [JP] | Japan | 3-39497 |
| Feb. 8, 1991 | [JP] | Japan | 3-39498 |
| Feb. 8, 1991 | [JP] | Japan | 3-39499 |
| Feb. 8, 1991 | [JP] | Japan | 3-39500 |

[51] Int. Cl.[5] ..... D05B 21/00

[52] U.S. Cl. ..... 112/121.12; 271/227; 271/241

[58] Field of Search ..... 112/121.12, 121.11, 112/306, 314, 309, 308, 121.15; 271/227, 241

[56] References Cited

U.S. PATENT DOCUMENTS

| | | | |
|---|---|---|---|
| 4,849,902 | 7/1989 | Yokoe et al. | 112/121.12 X |
| 4,917,030 | 4/1990 | Bisson et al. | 112/121.12 |
| 5,012,752 | 3/1991 | Murata et al. | 112/121.12 |
| 5,021,965 | 6/1991 | Olbrich | 112/121.12 |

*Primary Examiner*—Peter Nerbun

*Attorney, Agent, or Firm*—Oliff & Berridge

[57] ABSTRACT

A fabric position correcting device for correcting relative position of two fabrics in terms of alignment in at least one of outer profile lines and patterns of the fabrics. A pair of fabric holders are provided which respectively hold first and second fabrics. The holders are movable in X, Y directions, and angularly rotatable about a vertical axis for moving the respective fabrics. A pair of image sensors are provided for picking up at least one of outer profiles and patterns of the respective fabrics. Data from the image sensors are utilized for computation of moving distance and angular rotation angle of the holders in order to eliminate misalignment between two fabrics in terms of at least one of the profiles and patterns.

73 Claims, 30 Drawing Sheets

FIG. 16
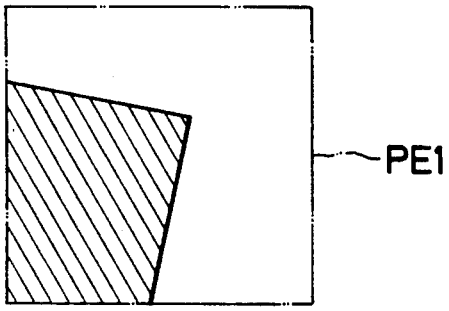
FIG. 17
| | | |
|---|---|---|
| 0 | 1 | 0 |
| 1 | −4 | 1 |
| 0 | 1 | 0 |
FIG. 18
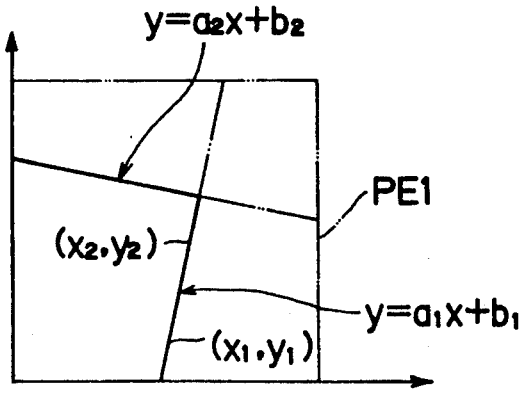

FABRIC POSITION CORRECTING DEVICE

BACKGROUND OF THE INVENTION

The present invention relates to a fabric position correcting device, and more particularly to a fabric position correcting device for correcting a positional deviation of one or two fabrics from a preset position or a relative position based on a detected position of an outer profile line and/or pattern of the fabric or fabrics.

Heretofore, there have been proposed various fabric position correcting devices for correcting a positional error of one or two fabrics so that the fabric or fabrics are brought into a preset position with respect to an outer profile line of the fabric or fabrics.

For example, Laid-Open Japanese Patent Application Kokai No. 63-164991 discloses a fabric position correcting device having three plates lying substantially horizontally and spaced vertically, and an edge guide positioned in front of a needle plate and supporting a pair of upper and lower abutments disposed between the three plates. Lower and upper fabrics are inserted between a lower side plate and an intermediate plate and between the intermediate plate and an upper side plate, respectively. The lower and upper fabrics are moved by compressed air in a direction normal to a fabric feeding direction until linear side edges of the lower and upper fabrics abut against linear side edges of the respective abutments, so that the positions of the side edges of the fabrics are corrected and a sewing margin is corrected. Thereafter, the fabrics are fed to a preset position in the fabric feeding direction to correct the positions of the leading ends of the fabrics. The fabrics that are aligned in the preset position are simultaneously fed to a predetermined stitching position.

However, the fabric position correcting device disclosed in the Japanese publication No. 63-164991 has the following problems: Since the abutments for correcting the sewing margin are attached to the edge guide, the abutments must be positionally adjusted each time the sewing margin is to be altered. Inasmuch as the positional correction in the direction normal to the fabric feeding direction is effected by the linear side edges of the abutments, the fabrics cannot be positionally corrected accurately with respect to outer profile lines thereof if the side edges of the fabrics are not linear in shape. The fabrics cannot be corrected in position by varying the relative position thereof because the relative position of the upper and lower abutments cannot be varied.

Further, there have been proposed a fabric position correcting devices for correcting a positional error of one or two fabrics so that the fabric or fabrics are brought into a preset position with respect to pattern of the fabric or fabrics.

For example, Japanese Patent Publication No. 2-46708 discloses a fabric pattern aligning device in which a fabric mount table which mounts thereon a fabric is drivingly rotatable and movable in X, Y directions by a fabric position correcting means, and a camera is provided for detecting a striped pattern of the fabric mounted on the table. Inclination angle of the striped pattern is computed based on an image data indicative of the striped pattern imaged through the camera. The table is driven by the fabric position correcting means in accordance with the computed inclination angle, so that the pattern can be directed in a predetermined orientation and can be positioned in a predetermined position, to thereby correct the positional deviation of the fabric. The thus corrected fabric is mounted on a fixing means.

According to the fabric pattern aligning device, displacement angle and position of the striped pattern can be corrected on a basis of the image data obtained by the image through the camera. However, the camera only picks-up the striped pattern on the fabric, and the picked-up portions of the fabrics are not constant with respect to every pick-up operation. Therefore, the position of the fabric held on the fixing means may be displaced in the strip pattern direction and a direction perpendicular thereto by integer times of a pitch of the striped pattern. With such a reason, in an attempt to stitch a pocket cloth to a predetermined position of a front garment with aligning pattern or striped patterns thereof with each other, it would be difficult to accurately correct relative positional deviation or error with respect to an outer profile and pattern of these fabrics.

SUMMARY OF THE INVENTION

It is an object of the present invention to provide a fabric position correcting device capable of accurately and reliably correcting the position of one or two fabrics with respect to the outer profile line and/or pattern thereof.

This and other objects of the invention will be attained by providing a fabric position correcting device for correcting a position of at least one fabric lying in a horizontal XY plane comprising (a) fabric holding means for holding at least a portion of a fabric, the fabric holding means being movable in X and Y directions in the XY plane and also angularly movable about a vertical axis so as to move the fabric to a desired position in the XY plane, (b) actuating means connected to the fabric holding means for moving the fabric holding means in the XY plane and angularly moving the fabric holding means about the vertical axis, (c) imaging means for imaging at least a portion of the fabric which is placed in a predetermined imaging range in the XY plane, the imaging means producing image signals, (d) memory means connected to the imaging means for storing image data converted from the image signals, (e) processing means for detecting at least one of an outer profile line and a pattern of the fabric based on the image data retrieved from the memory means and computing an error distance in the X and Y directions and an error angle about the vertical axis of the detected one of the outer profile line and the pattern from a preset position, and (f) control means connected to the actuating means for controlling the actuating means to correct the position of the fabric until the error distance and the error angle computed by the processing means are eliminated while the fabric is being held by the fabric holding means.

In another aspect of the present invention thre is provided a fabric position correcting device for correcting a position of at least one fabric lying in a horizontal XY plane comprising (a) fabric holding means for holding at least a portion of a fabric, the fabric holding means being movable in X and Y directions in the XY plane and also angularly movable about a vertical axis so as to move the fabric to a desired position in the XY plane, (b) actuating means connected to the fabric holding means for moving the fabric holding means in the XY plane and angularly moving the fabric holding means about the vertical axis, (c) imaging means for imaging at least a portion of the fabric which is placed in a predetermined imaging range in the XY plane, the imaging means producing image signals, (d) memory means connected to the imaging means for storing image data converted from the image signals, (e) processing means for detecting at least one of an outer profile line and a pattern of the fabric based on the image data retrieved from the memory means and computing an error distance in the X and Y directions and an error angle about the vertical axis of the detected one of the outer profile line and the pattern from a preset position, and (f) control means connected to the actuating means for controlling the actuating means to feed the fabric to a desired final algnment position while correcting the position of the fabric until the error distance and the error angle computed by the processing means are eliminated, the feeding and correcting operation being simultaneously performed while the fabric is being held by the fabric holding means.

BRIEF DESCRIPTION OF THE DRAWINGS

In the drawings;

FIG. 16 is a diagram showing image data converted into binary data;

FIG. 17 is a diagram of a Laplacian filter;

FIG. 18 is a diagram showing the manner in which two outer profile lines at a corner of a fabric are determined;

DETAILED DESCRIPTION OF THE PREFERRED EMBODIMENTS

A fabric position correcting device according to one embodiment of the present invention will hereinafter be described with reference to the drawings.

In this embodiment, the present invention is applied to a fabric position correcting device for feeding two fabrics with the same pattern (striped pattern) drawn thereon, to a stitching position where the fabrics can be sewn on a sewing machine, while aligning the fabrics along their outer profile lines.

Figure 1:
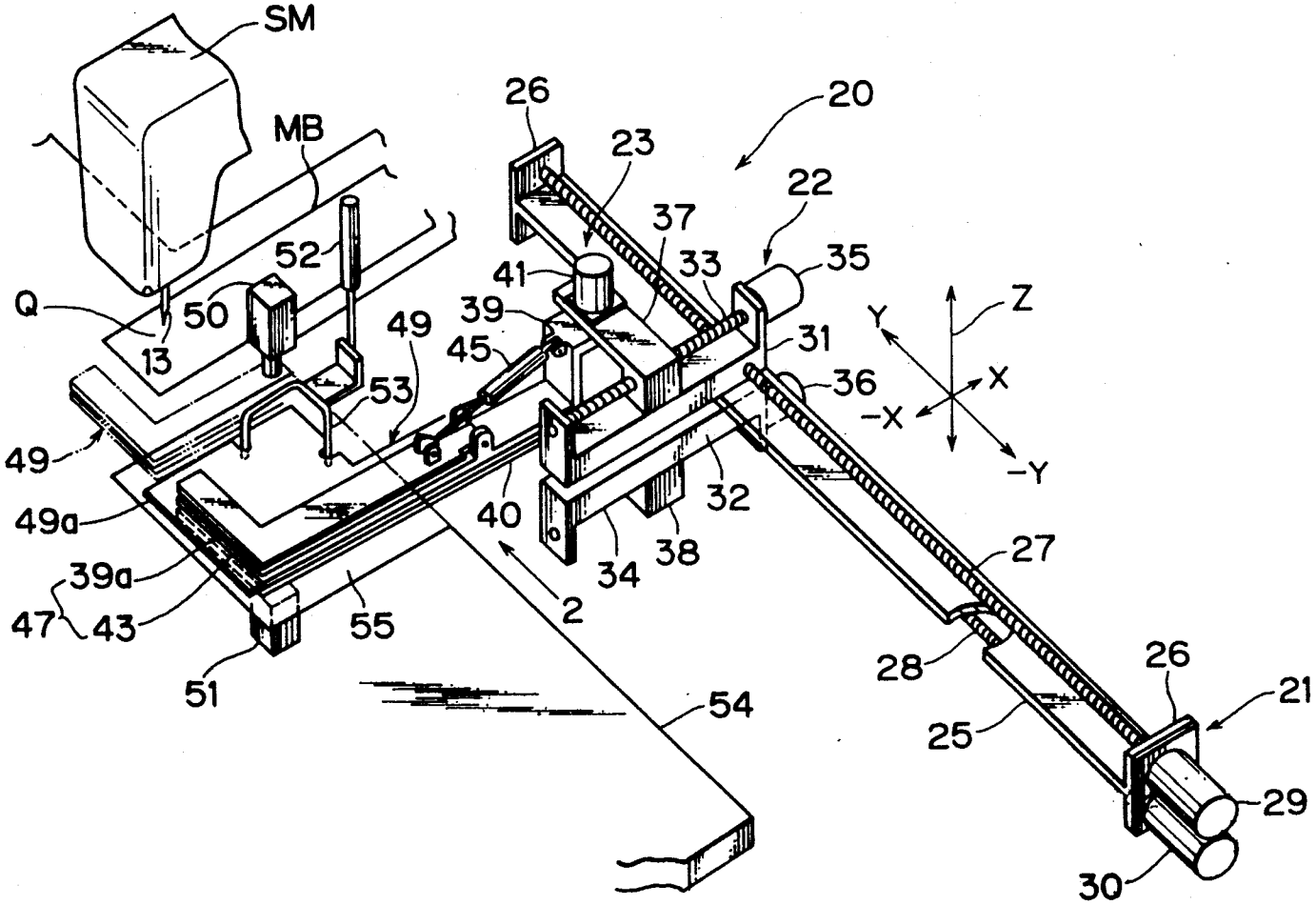
FIG. 1 is a perspective view showing a fabric position correcting device according to one embodiment of this invention.

First, a lock-stitch sewing machine SM for sewing fabrics will be described below. The lock-stitch sewing machine is a general sewing machine having a needle thread takeup lever actuating mechanism which is actuated by a sewing machine spindle rotated by a sewing machine motor 10 (FIG. 3), a needle bar actuating mechanism for actuating a needle bar vertically, a feed dog actuating mechanism, a thread loop catcher, and an automatic thread cutter. The sewing machine SM also has a presser bar with a presser foot mounted on the lower end thereof. The presser bar is movable by a solenoid 11 (see FIG. 3) between a pressing position in which the presser foot presses a fabric and an elevated position. When the needle bar is in an operative position (upper position), a needle position sensor 12 (see FIG. 3) which may comprise a photosensor produces an operative position signal. In FIG. 1, a sewing needle 13 is mounted on the lower end of the needle bar, and is positioned over a bed MB where the sewing needle 13 descends at a needle location Q.

A fabric position correcting device 20 disposed in front of the sewing machine SM will be described below with reference to FIGS. 1 and 2.

The fabric position correcting device 20 includes a Y-direction actuating mechanism 21 for moving fabrics W1, W2 in a Y direction (back and forth) in a horizontal XY plane, an X-direction actuating mechanism 22 for moving the fabrics W1, W2 in an X direction (lateral) normal to the Y direction, and an angularly actuating mechanism 23 for angularly moving the fabrics W1, W2 horizontally about a vertical axis parallel to a Z direction (vertical) normal to the X and Y directions, through holders 47, 48 (described later on). These mechanisms 21 through 23 will be described below.

A support base 25 having a certain width is horizontally supported on a machine frame (not shown) in front of the sewing machine SM. The support base 25 extends in a Y direction. Side plates 26 are attached to the front and rear ends, respectively, of the support base 25. A first Y-direction ball screw shaft (hereinafter referred to as a "first Y-direction shaft") 27 is mounted on the upper side of the support base 25 and extends parallel thereto. A second Y-direction ball screw shaft (hereinafter referred to as a "second Y-direction shaft") 28 is mounted on the lower side of the support base 25 and extends parallel thereto. The Y-direction shafts 27, 28 are rotatably supported at their front and rear ends on the side plates 26. To the front side plate 26, there are fixed a first Y-direction drive motor (hereinafter referred to as a "first Y motor") 29 and a second Y-direction drive motor (hereinafter referred to as a "second Y motor") 30. The first Y motor 29 has a drive shaft coupled to the first Y-direction shaft 27, and the second Y motor 30 has a drive shaft coupled to the second Y-direction shaft 28. The motors 29, 30 are stepper motors, respectively.

The first Y-direction shaft 27 is threaded through a ball screw nut in a proximal end portion of a first Y-direction movable base 31 that is slidably held against an upper surface of the support base 25 and extends in the X direction. The second Y-direction shaft 28 is threaded through a ball screw nut in a proximal end portion of a second Y-direction movable base 32 that is slidably held against a lower surface of the support base 25 and extends in the X direction. When the first Y motor 29 is energized to rotate the first Y-direction shaft 27 about its own axis, the first Y-direction movable base 31 moves back and forth (in the Y-direction). Similarly, when the second Y motor 30 is energized to rotate the second Y-direction shaft 28 about its own axis, the second Y-direction movable base 32 moves back and forth.

A first X-direction ball screw shaft (hereinafter referred to as a "first X-direction shaft") 33 is mounted on the first Y-direction movable base 31 and extends parallel thereto. The first X-direction shaft 33 is rotatably supported at its lefthand and righthand ends on lefthand and righthand side walls of the first Y-direction movable base 31. A second X-direction ball screw shaft (hereinafter referred to as a "second X-direction shaft") 34 is mounted on the second Y-direction movable base 32 and extends parallel thereto. The second X-direction shaft 34 is rotatably supported at its lefthand and righthand ends on lefthand and righthand side walls of the second Y-direction movable base 32. A first X-direction drive motor (hereinafter referred to as a "first X motor") 35 is fixed to one of the side walls of the first Y-direction movable base 31, and a second X-direction drive motor (hereinafter referred to as a "second X motor") 36 is fixed to one of the side walls of the second Y-direction movable base 32. The first X motor 35 has a drive shaft coupled to the first X-direction shaft 33, and the second X motor 36 has a drive shaft coupled to the second X-direction shaft 34. The motors 35, 36 are stepper motors, respectively.

The first X-direction shaft 33 is threaded through a ball screw nut in a front end portion of a first X-direction movable base 37 that is slidably held against an upper surface of the first Y-direction movable base 31 and extends in the Y direction. The second X-direction shaft 34 is threaded through a ball screw nut in a front end portion of a second X-direction movable base 38 that is slidably held against a lower surface of the second Y-direction movable base 32 and extends in the Y direction. When the first X motor 35 is energized to rotate the first X-direction shaft 33 about its own axis, the first X-direction movable base 37 moves laterally (in the X-direction). Similarly, when the second X motor 36 is energized to rotate the second X-direction shaft 34 about its own axis, the second X-direction movable base 38 moves laterally.

Figure 2:
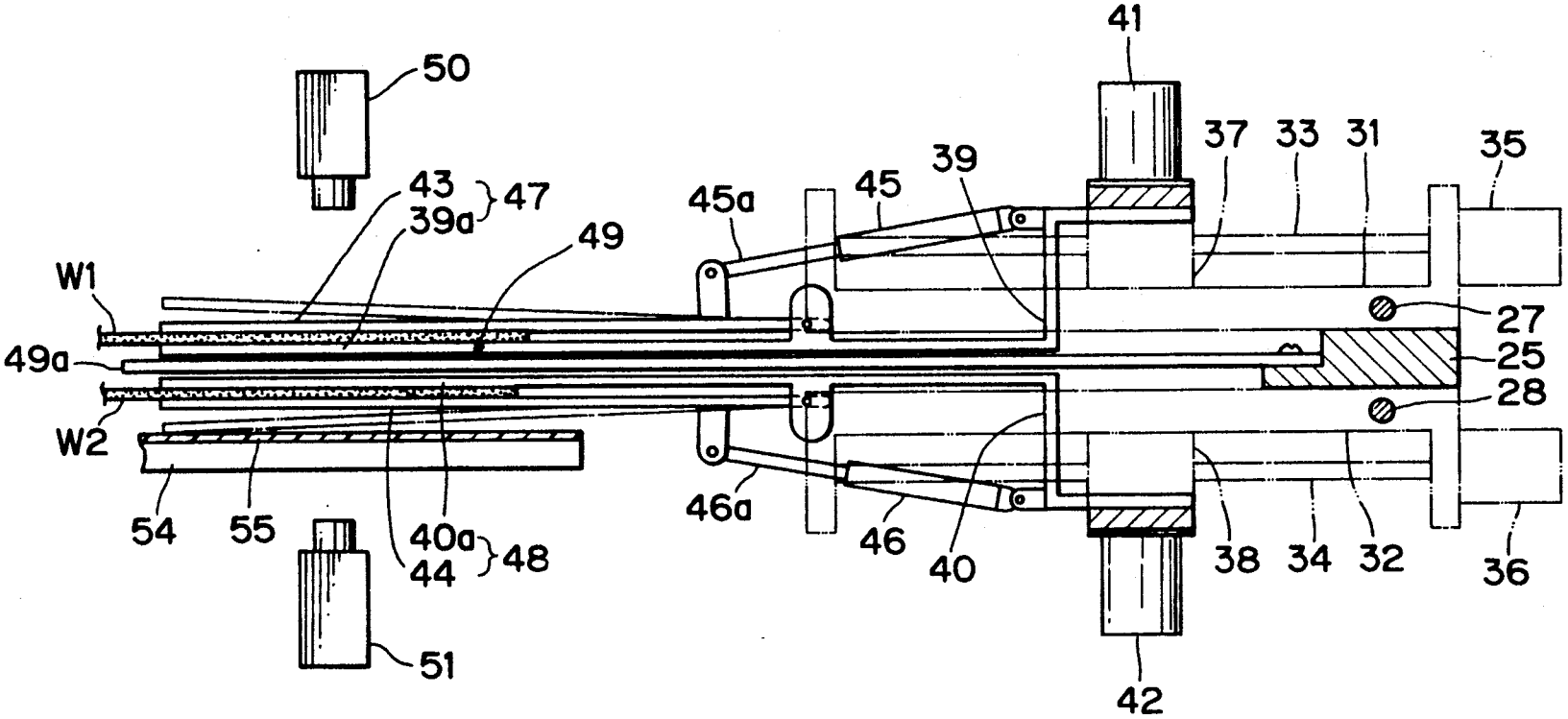
FIG. 2 is a cross-sectional side view as viewed in a direction indicated by an arrow 2 in FIG. 1.

As shown in FIGS. 1 and 2, a first turn arm 39 in a form of a crank that extends to the left for holding the upper fabric W1 is horizontally angularly movably mounted at a proximal end thereof on a rear end portion of the first X-direction movable base 37. A second turn arm 40 in a form of a crank that extends to the left for holding the lower fabric W2 is horizontally angularly movably mounted at a proximal end thereof on a rear end portion of the second X-direction movable base 38. The first turn arm 39 is angularly movable by a first turn motor 41 fixedly mounted on the rear end portion of the first X-direction movable base 37, and the second turn arm 40 is angularly movable by a second turn motor 42 fixedly mounted on the rear end portion of the second X-direction movable base 38. The turn arms 39, 40 have respective first and second holder members **39*a*, 40*a* bent horizontally rearwardly from their distal ends for reliably holding the upper and lower fabrics W1, W2. Therefore, when the first turn motor 41 is energized, the first turn arm 39 is angularly moved about a drive shaft of the first turn motor 41. When the second turn motor 42 is energized, the second turn arm 40 is angularly moved about a drive shaft of the second turn motor 42. The motors 41, 42** are stepper motors, respectively.

As shown in FIGS. 1 and 2, a first holding member 43 which is L-shaped in plan is disposed on the upper side of the first holder member 39*a*. The first holding member 43 is pivotally mounted at its righthand end for vertical swinging movement between a clamp position indicated by the solid line and an angularly moved position indicated by the two-dot-and-dash line. Likewise, a second holding member 44 which is L-shaped in plan is disposed on the lower side of the second holder member 40*a*. The second holding member 44 is pivotally mounted at its righthand end for vertical swinging movement between a clamp position indicated by the solid line and an angularly moved position indicated by the two-dot-and-dash line. A first pneumatic cylinder 45 is operatively coupled between the first turn arm 39 and the first holding member 43 for angularly moving the first holding member 43, and a second pneumatic cylinder 46 is operatively coupled between the second turn arm 40 and the second holding member 44 for angularly moving the second holding member 44. The first holder member 39*a* and the first holding member 43 jointly serve as a first holder 47 for clamping the upper fabric W1, and the second holder member 40*a* and the second holding member 44 jointly serve as a second holder 48 for clamping the lower fabric W2. The holders 47, 48 are independently movable in the X and Y directions in the horizontal XY plane, and also angularly movable about a movable vertical axis.

As shown in FIG. 2, the first pneumatic cylinder 45 has a piston rod 45*a* which, when projected, moves the first holding member 43 into the clamp position in which the fabric W1 is reliably clamped by the first holder 47 (between the first holder member 39*a* and the first holding member 43). Likewise, the second pneumatic cylinder 46 has a piston rod 46*a* which, when projected, moves the second holding member 44 into the clamp position in which the fabric W2 is reliably clamped by the second holder 48 (between the second holder member 40*a* and the second holding member 44).

As shown in FIG. 2, a separator plate 49 fixed at its proximal end to the support base 25 extends horizontally between the turn arms 39, 40. The separator plate 49 has on its distal end a rectangular enlarged portion 49*a* for separating the fabrics W1, W2 from each other that are clamped by the holders 47, 48, respectively.

Figure 11:
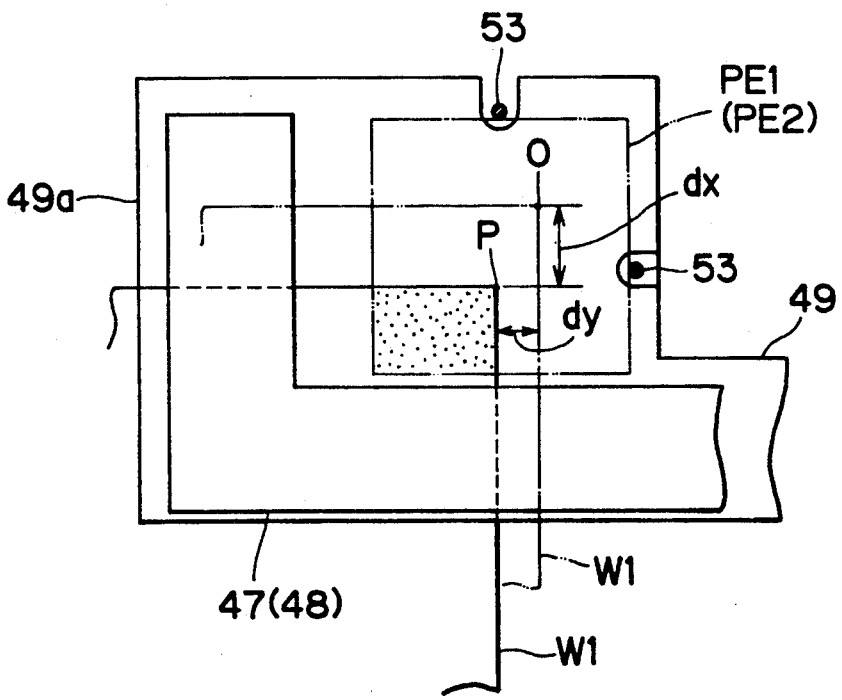
FIG. 11 is a fragmentary plan view showing imaging ranges according to one embodiment of this invention.

A first two-dimensional image sensor 50 which comprises a CCD (charge-coupled device) with a color filter is disposed upwardly of the enlarged portion 49*a* for detecting a portion of the first fabric W1 clamped by the first holder 47 through a color image pick-up or imaging process. Similarly, a second two-dimensional image sensor 51 which is identical to the first image sensor 50 is disposed downwardly of the enlarged portion 49*a* for detecting a portion of the second fabric W2 clamped by the second holder 48 through a color image pick-up or imaging process. The first image sensor 50 picks-up a portion or a predetermined range of the fabric W1 placed above the separator plate 49, and outputs a color image signal, and the second image sensor 51 images a portion or a predetermined range of the fabric W2 placed below the separator plate 49, and outputs a color image signal. The predetermined range having a square shape, in which the fabric W1 is picked-up by the first image sensor 50, is regarded as a first image pick-up or imaging range PE1 over the separator plate 49. Further, the predetermined range having a square shape, in which the fabric W2 is picked-up by the second image sensor 51, is regarded as a second image pick-up or imaging range PE2 over the separator plate 49, as shown in FIG. 11. These imaging ranges PE1, PE2 are of identical size, and identically positioned with respect to the separator plate 49. The imaging ranges PE1, PE2 have sides each extending parallel to the X or Y direction. When the holders 47, 48 are positioned with respect to the imaging ranges RE1, RE2 as shown in FIG. 11, the holders 47, 48 are in an image pick-up or imaging position.

An indicator 53 is provided for clearly indicating a setting position of corner portions of the fabrics W1, W2 when manually setting these fabrics in the respective imaging ranges PE1, PE2. More specifically, the indicator 53 is vertically movable between an elevated position and a lowered position by a pneumatic cylinder 52, as shown in FIG. 1. When the indicator 53 is in the lowered position, it indicates two adjacent boundary lines of each of the imaging ranges PE1, PE2 (see FIG. 11).

As shown in FIG. 1, a support table 54 for supporting the fabrics W1, W2 in the holders 47, 48 parallel to the separator plate 49 is disposed at the same level or height as the bed MB. The support table 54 is formed with a recess defined therein below the enlarged portion 49*a* and slightly larger than the enlarged potion 49*a*. A transparent glass plate 55 is fitted in the recess to allow the second image sensor 51 to image the fabric W2.

Figure 3:
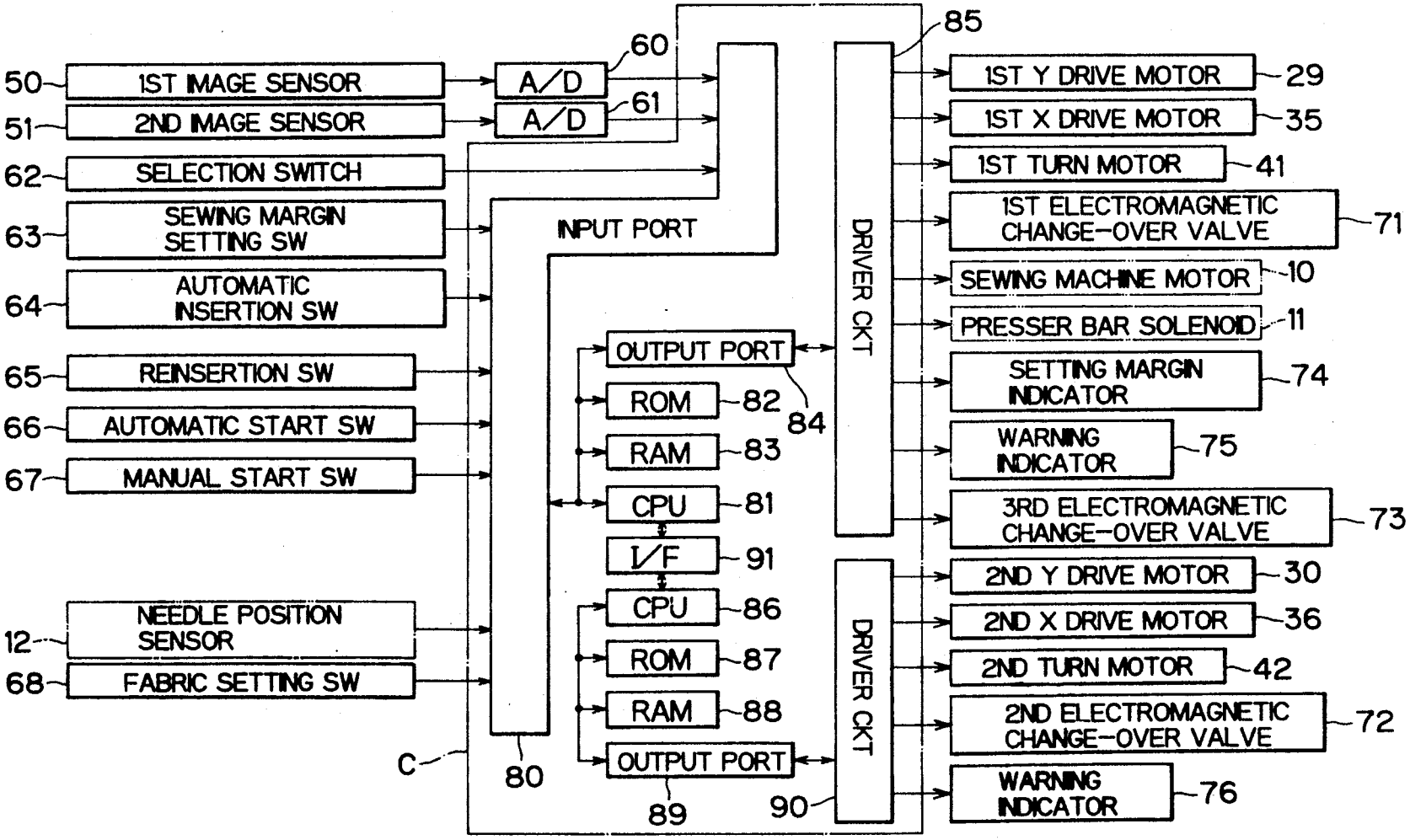
FIG. 3 is a block diagram showing a control system of the fabric position correcting device according to one embodiment of this invention.
Figure 4:
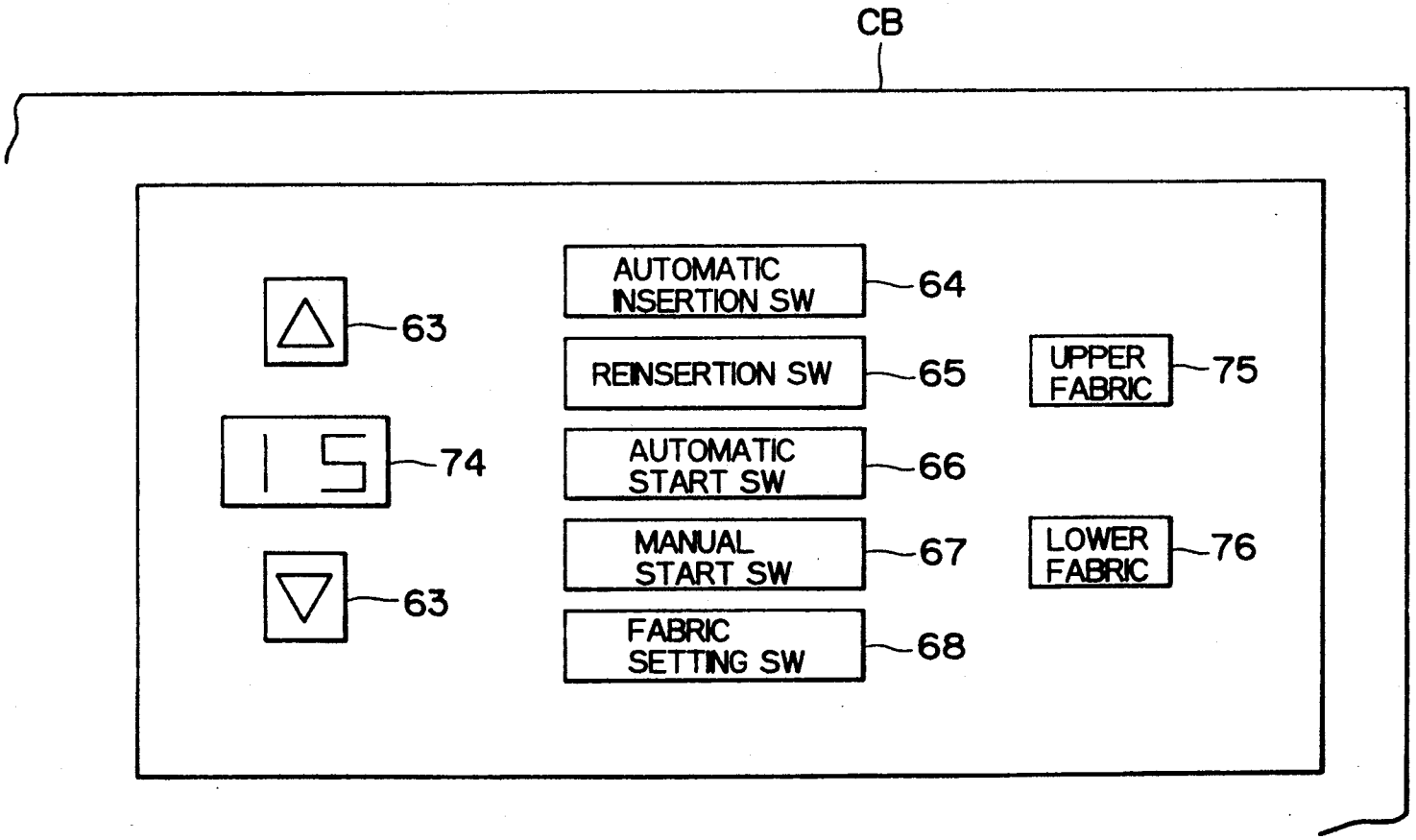
FIG. 4 is an enlarged fragmentary front elevational view showing a control box according to one embodiment of this invention.

The fabric position correcting device 20 has a control system housed in a control box CB (FIG. 4). The control system is arranged as shown in FIG. 3.

The control system includes a controller C having an input port 80 to which the first and second image sensors 50, 51 are connected through respective A/D converters 60, 61. To the input port 80, there are also connected a sewing margin setting switch 63, an automatic insertion switch 66 for automatically inserting the fabrics W1, W2 into the respective imaging ranges PE1, PE2, a reinsertion switch 65 to be operated on when the fabrics W1, W2 are reinserted, an automatic start switch 66 for automatically continuously controlling alignment of the fabrics W1, W2, a manual start switch 67 for manually controlling alignment of the fabrics W1, W2, and a fabric setting switch 68 to be operated on when the manual setting of the fabrics W1, W2 is completed. The needle position sensor 12 is also connected to the input port 80.

The controller C includes a main CPU 81 for mainly controlling positional correction for the fabric W1, a ROM 82, a RAM 83, an output port 84, and a driver circuit 85. The input port 80, the ROM 82, the RAM 83, the output port 84, and the driver circuit 85 are connected to the main CPU 81 through a bus such as a data bus. The controller C also includes a slave CPU 86 for controlling positional correction for the fabric W2, a ROM 87, a RAM 88, an output port 89, and a driver circuit 90. The ROM 87, the RAM 88, the output port 89, and the driver circuit 90 are connected to the CPU 86 through a bus. The main CPU 81 and the slave CPU 86 are connected to each other through an interface 91.

The ROMs 82 and 87 are adapted to store control programs for controlling the positional correction for the fabrics W1, W2. Further, the RAM 83 serves as an image data memory, and is adapted to store therein a digital image signal converted by the A/D converter 60 from an image signal generated from the first image sensor 50. The image data comprise a number of data corresponding to the pixels of the CCD of the first image sensor 50, and each representing the density of one of successive levels "0" to "255." The same is true with respect to the RAM 88 in connection with the second image sensor.

The sewing machine motor 10, the solenoid 11, the first Y motor 29, the first X motor 35, the first turn motor 41, a first electromagnetic change-over valve 71, a sewing margin indicator 74, a warning indicator 75, and a third electromagnetic change-over valve 73 are connected to the driver circuit 85. Further, the second Y motor 30, the second X motor 36, the second turn motor 42, a second electromagnetic change-over valve 72, and a warning indicator 76 are connected to the driver circuit 90. The first electromagnetic change-over valve 71 actuates the first pneumatic cylinder 45 to project and retract its piston rod 45*a*. The second electromagnetic change-over valve 72 actuates the second pneumatic cylinder 46 to project and retract its piston rod 46*a*. The third electromagnetic change-over valve 73 actuates the pneumatic cylinder 52 to project and retract its piston rod which is connected to the indicator 53. The sewing margin indicator 74 indicates a sewing margin. The warning indicators 75, 76 serve to prompt the operator to set the fabrics W1, W2 again.

A routine or a control program for controlling the positional correction for the fabrics W1, W2, which is executed by the controller C of the fabric position correcting device 20, will be described below with reference to the flowcharts of FIGS. 5 through 10. The control program is stored in the ROM 82. Denoted at Si (i=1, 2, 3, . . . ) in FIGS. 5 through 10 are steps of the routine.

When the power supply of the fabric position correcting device 20 is turned on, the control sequence is started. First, the various components of the fabric position correcting device 20 are initialized in a step S1. More specifically, in the step S1, the first and second Y motors 29, 30, the first and second X motors 35, 36, the first and second turn motors 41, 42 are energized to move the first and second holders 47, 58 into the imaging position shown in FIG. 11. The first and second electromagnetic change-over valves 71, 72 are actuated to shift the first and second holding members 43, 44 into the angularly moved positions (two-dot-and-dash lines in FIG. 2), respectively. The third electromagnetic change-over valve 73 is actuated to move the indicator 53 into the lowered position.

Fabrics W1, W2 are subsequently fed into a given position by a fabric loading device (not shown). In response to a loading completion signal from the fabric loading device or a loading completion signal from the fabric setting switch 68 that is operated on after the fabrics W1, W2 are manually set in position (step S2: Yes), the main CPU 81 instructs the slave CPU 86 to set the fabric W2 in the second imaging range PE2 in a step S3.

Then, the main CPU 81 executes a control process to set the fabric W1 in the first imaging range PE1 as follows:

(1) It is assumed that the automatic start switch 66 and the automatic insertion switch 64 are rendered off. After it is determined that the automatic start switch 66 is rendered off (step S4: No), if the manual start switch 67 is turned on (step S5: Yes) and the warning indicator 75 is turned on (step S6: Yes), then the warning indicator 75 is turned off in a step S7. Thereafter, the first image sensor 50 reads an image within the first imaging range PE1 to generate an image signal. The image signal from the first image sensor 50, representing image data within the first imaging range PE1, is converted by the A/D converter 60 into a digital image signal which is stored in the RAM 83 as an image data memory in a step S8. The image data comprise a number of data corresponding to the pixels of the CCD of the first image sensor 50, and each representing the density of one of successive levels "0" to "255."

Figure 12:
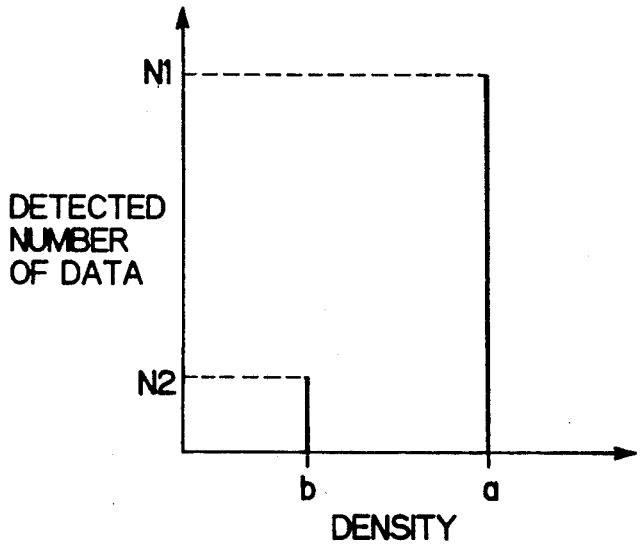
FIG. 12 is a diagram showing the relationship between densities and detected numbers of image data of a fabric detected in an imaging range.
Figure 13:
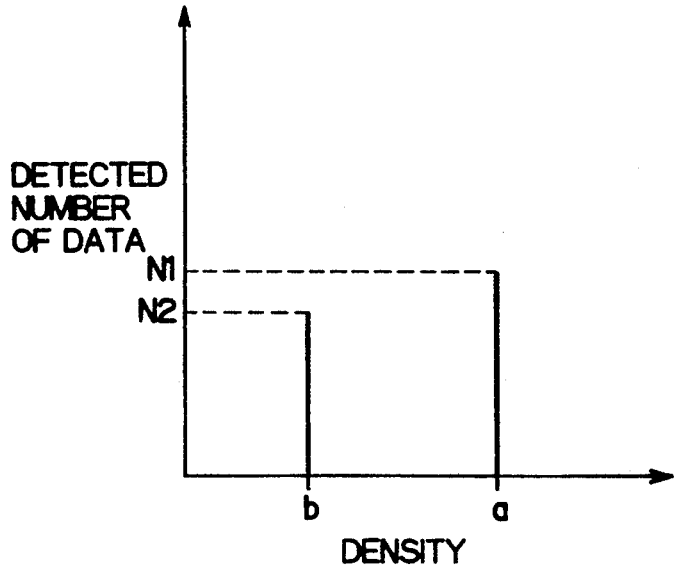
FIG. 13 is a diagram showing the relationship between densities and detected numbers of image data of a fabric detected in an imaging range, and in which a occupying area of a fabric in the imaging range is greater than that in a state shown in FIG. 12.

Then, a step S9 calculates a proportion (detected proportion) D of the fabric W1 within the first imaging range PE1 based on the image data. For example, it is assumed that the corner of the fabric W1 is set in a position indicated by the solid line with respect to the first imaging range PE1, as shown in FIG. 11. As shown in FIG. 12, the detected number of image data with respect to a density "a" corresponding to the separator plate 49 is N1 (own color density of the separator plate 49 portion which is not covered by the fabric W1 is detected), and the detected number of image data with respect to a density "b" corresponding to the fabric W1 is N2 (own color density of the fabric W1 is detected). The sum of the number N1 and the number N2 is equal to a total number N of pixels of the CCD of the first image sensor 50. Therefore, the detected proportion D of the detected number N2 in the total number N of pixels can be determined. When the corner of the fabric W1 is set in a position indicated by the two-dot-and-dash line with respect to the first imaging range PE1, the detected number N1 is reduced (since the separator plate 49 is covered by the fabric W1 by an increased area with respect to the first imaging range PE1) and the detected number N2 is increased, as shown in FIG. 13, so that the detected proportion D of the fabric W1 is increased.

Figure 9:
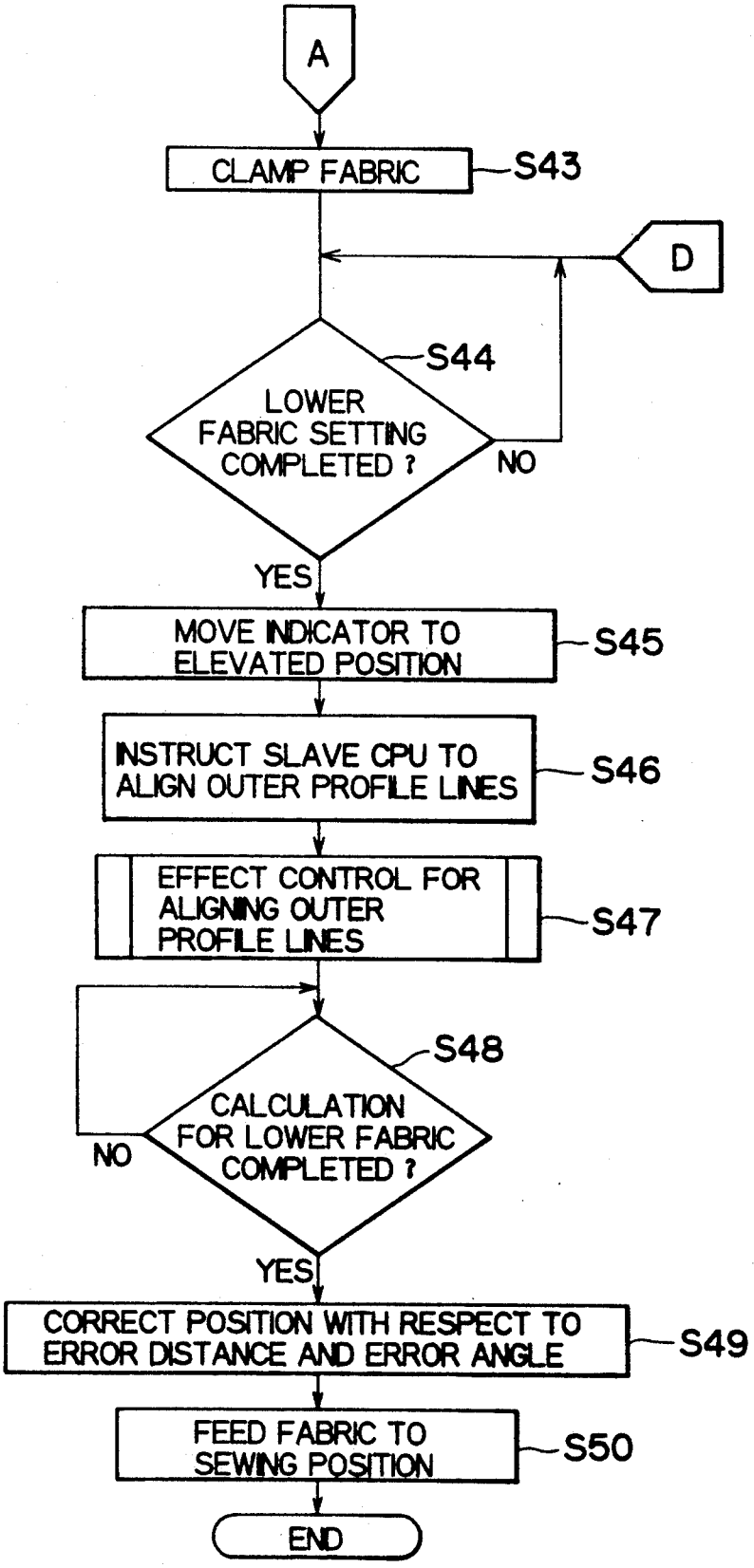
Figure 10:
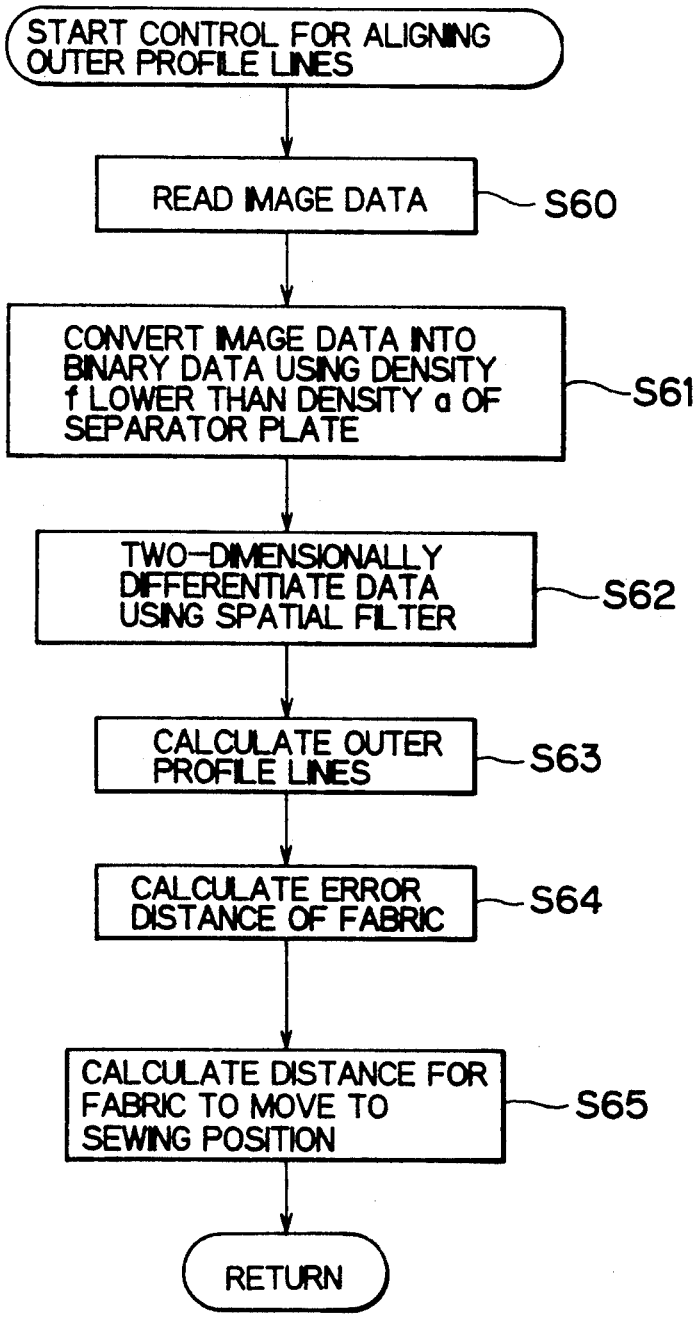

Since the automatic insertion switch 64 is rendered off (step S10: No), the routine proceeds into a step S11 for determining whether or not the detected proportion D of the fabric W1 is equal to or greater than a predetermined value A (e.g., 45 %). If the detected proportion D is equal to or greater than the predetermined value A (step 11: Yes), then the routine goes to a step S43 (FIG. 9; described later). If the detected proportion D is smaller than the predetermined value A (step 11: No), then the routine goes to a step S12 in which the warning indicator 75 is turned on, and control returns to the step S2.

Figure 6:
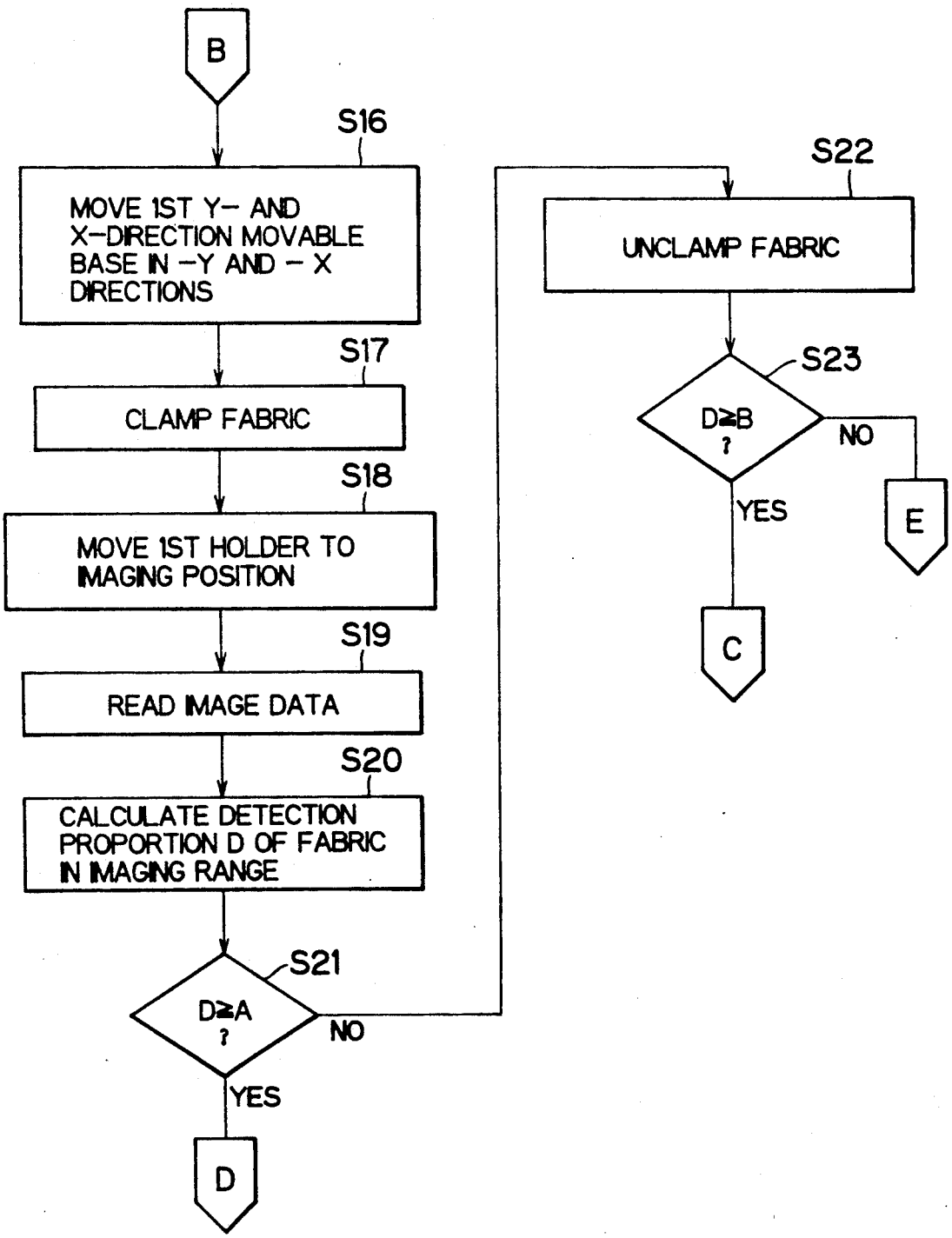
Figure 7:
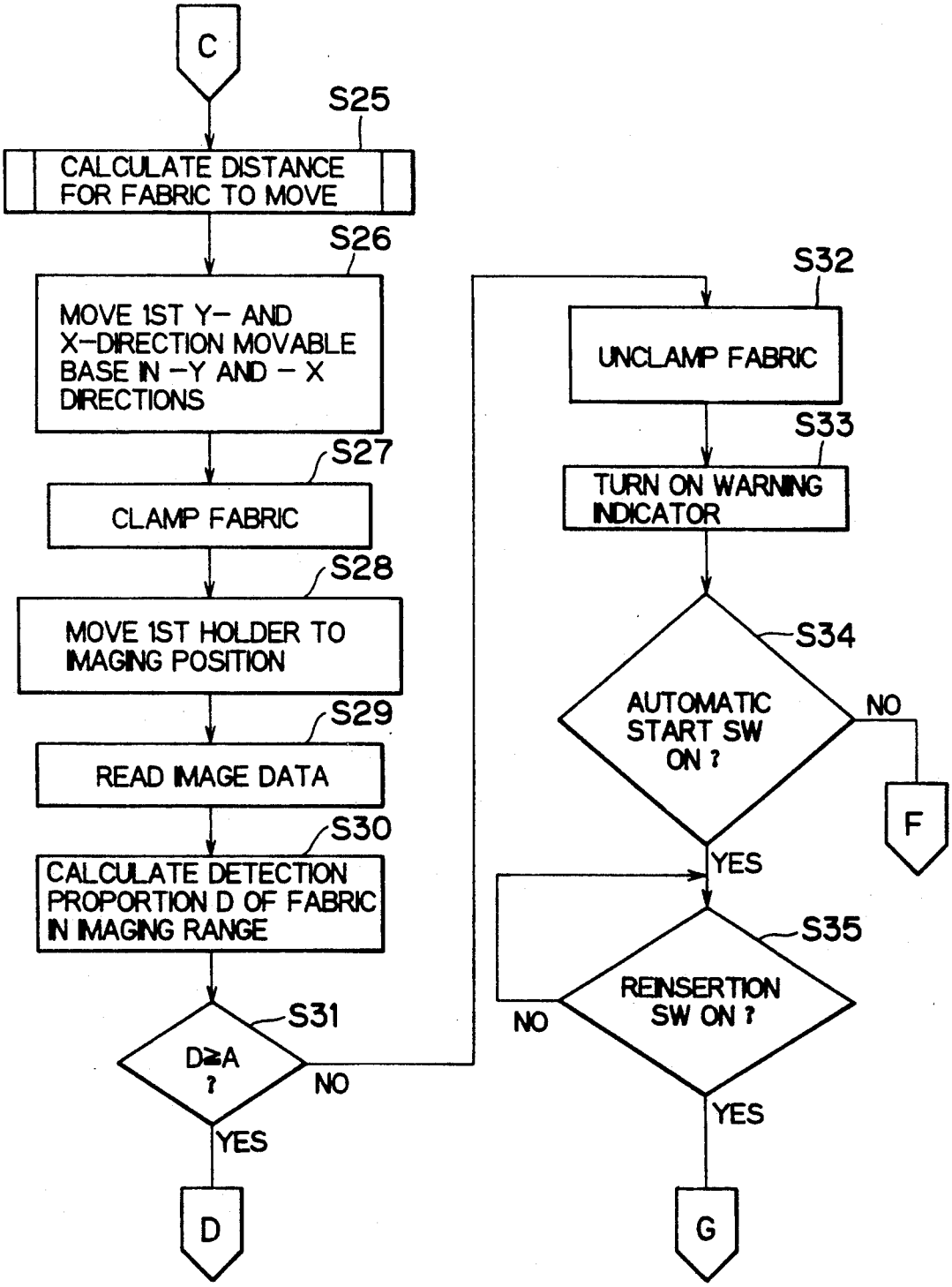
Figure 8:
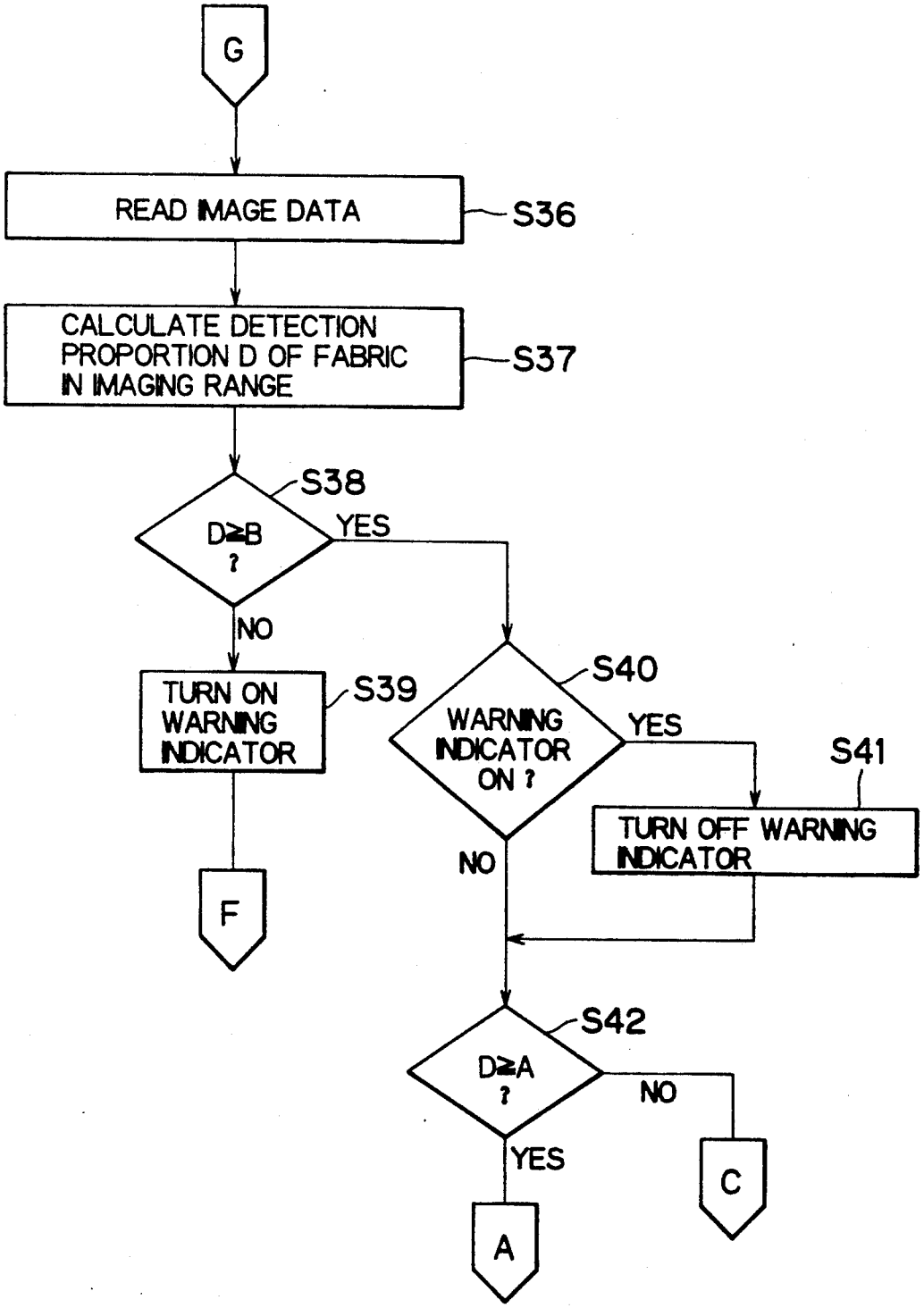

(2) Next, it is assumed that the automatic start switch 66 is rendered off and the automatic insertion switch 64 is rendered on. After it is determined that the automatic start switch 66 is rendered off (step S4: No), the steps S5 through S9 are executed, as described above, and then it is determined that the automatic insertion switch 64 is rendered on (step S10: Yes). Thereafter, if the detected proportion D of the fabric W1 is equal to or greater than a predetermined value B (e.g., 10%) and also equal to or greater than the predetermined value A (steps S13, S14: Yes), then the routine goes to the step S43 (FIG. 9). On the other hand, if the detected proportion D is smaller than the predetermined value B (step S13: No), the fabric W1 is automatically inserted into the first imaging range PE1 in steps S16 through S18 as shown in FIG. 6. More specifically, in order to make the detected proportion D equal to or greater than the predetermined value A, the first Y motor 29 and the first X motor 35 are energized to move the first holder 47 from the present imaging position by a certain distances in −Y and −X directions based on a predetermined distance that substantially corresponds to the length (about 10 cm) of one side of the first imaging range PE1, in a step S16. The fabric W1 is clamped by the first holder 47 in a step S17. Thereafter, the first holder 47 is returned to the original imaging position based on the above predetermined distance, thereby automatically inserting the fabric W1 into the first imaging range PE1 in a step S18.

Then, the image data of the fabric W1 that has been automatically inserted is read in a step S19, and the detected proportion D of the fabric W in the imaging range is calculated in a step S20. If the detected proportion D is equal to or greater than the predetermined value A (step S21: Yes), then control goes to a step S44 (FIG. 9). If the detected proportion D is smaller than the predetermined value A (step S21: No), then the fabric W1 is unclamped from the first holder 47 in a step S22. If, thereafter, the detected proportion D is equal to or greater than the predetermined value B (step S23: Yes), then the fabric W1 is automatically inserted again in steps S25 through S28 shown in FIG. 7. If the detected proportion D is smaller than the predetermined value B (step S23: No), then the warning indicator 75 is turned on in the step S12, and the control goes back to the step S2.

If the detected proportion D is smaller than the predetermined value A (step S14: No) and also equal to or greater than the predetermined value B (step S23: Yes), i.e., if the fabric W1 is set in the position indicated by the solid line in FIG. 11, then a point P of intersection (corner) of two outer profile lines of the fabric W1, which are represented by large changes in the densities corresponding to pixels, are determined based on the image data, and distances dx, dy from the point P of intersection to a point 0 where the detected proportion D is greater than the predetermined value A are determined in a step S25. Then, the first Y motor 29 and the first X motor 35 are energized to move the first holder 47 by the distance dy in the −Y direction and the distance dx in the −X direction in a step S26. Based on the distances dx, dy, the first holder 47 is returned to the original imaging position in a step S28.

Figure 5:
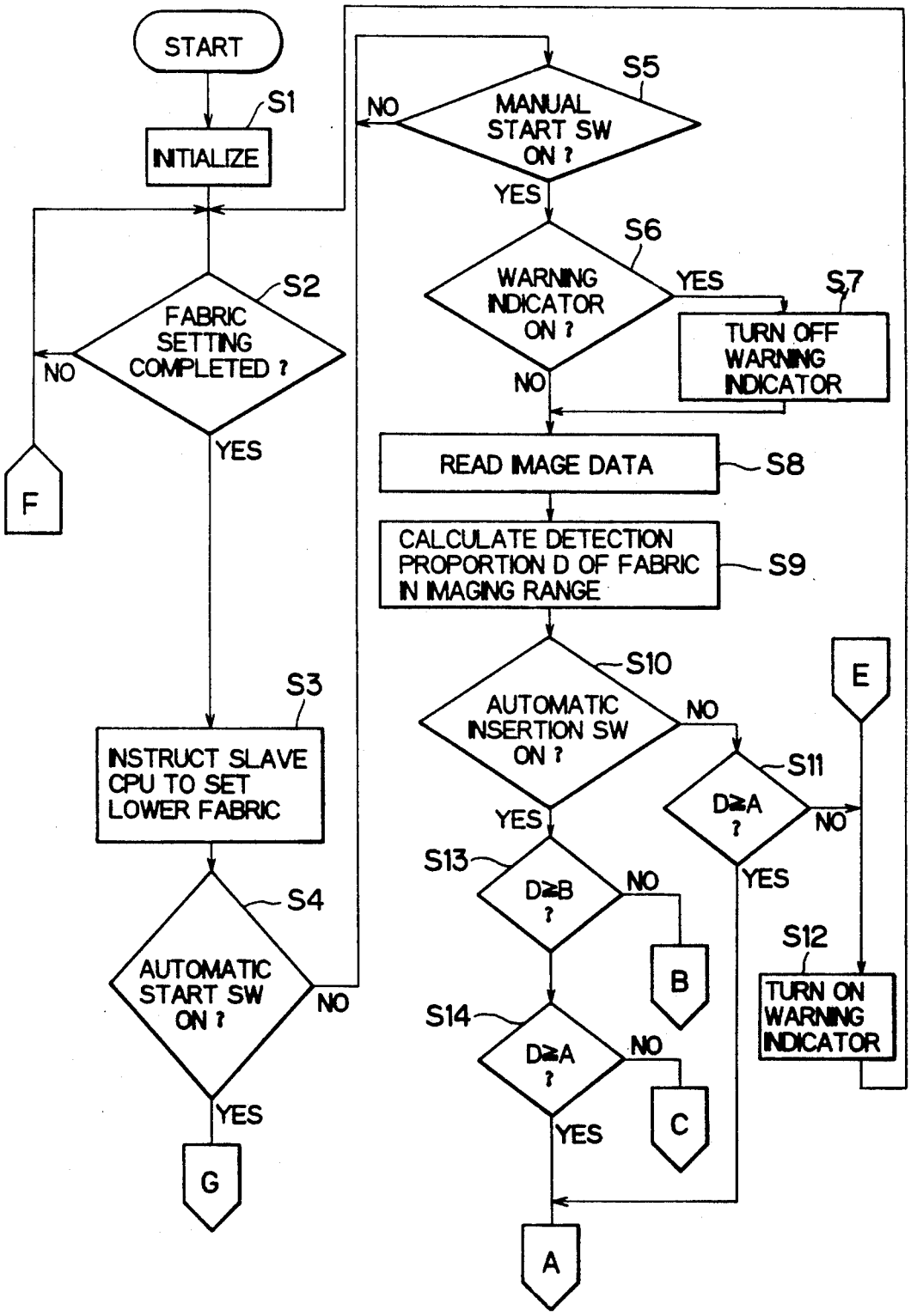
FIGS. 5 through 10 are portions of schematic flowchart showing a routine for positional correction control.

The image data of the fabric W1 after having been moved is read again in a step S29, and then the detected proportion D of the fabric W1 with respect to the first imaging range PE1 is calculated in a step S30. If the detected proportion D is equal to or greater than the predetermined value A (step S31: Yes), then control proceeds to the step S44 (FIG. 9). If the detected proportion D is smaller than the predetermined value A (step S31: No), then the fabric W1 is unclamped in a step S32, and the warning indicator 75 is turned on in a step S33. Since the automatic start switch 66 is turned off (step S34: No), control goes back to the step S2 (FIG. 5).

(3) It is assumed that the automatic start switch 66 is rendered on and the automatic insertion switch 64 is rendered on. After it is determined that the automatic start switch 66 is rendered on (step S4: Yes), the image data of the fabric W1 is read in a step S36, and the detected proportion D of the fabric W1 with respect to the first imaging range PE1 is calculated in a step S37. If the detected proportion D is smaller than the predetermined value B (S38; No), the warning indicator 75 is turned on in a step S39, and the routine goes back to the step S2. On the other hand, if the detected proportion D is equal to or greater than the predetermined value B (step S38: Yes), determination is made as to whether or not the warning indicator 75 is rendered on in a step S40, and if the determination falls Yes, the routine goes into a step S41 to turn off the indicator 75. Then, if the detected proportion D is equal to or greater than the predetermined value A (step S42: Yes), then routine goes to the step S43 (FIG. 9). If the detected proportion D is smaller than the predetermined value A (step S42: No), then the steps S25 through S30 described above are executed as shown in FIG. 7. After the steps S25 through S30, if the detected proportion D is equal to or greater than the predetermined value A (step S31: Yes), then control goes to the step S44. If the detected proportion D is still smaller than the predetermined value A, then the steps S32 through S34 are executed, prompting the insertion of the fabric W1 again.

If the answers to the decision steps S11, S14, S42 are Yes, then the fabric W1 is clamped by the first holder 47 in the step S43. If the answers to the decision steps S21, S31 are Yes, then after the setting of the fabric W1 is completed, the step S44 is repeated until a setting completion signal indicating the completion of setting of the second fabric W2 is inputted from the CPU 86. More specifically, based on the control program stored in the ROM 87 for setting the second fabric W2, the CPU 86 executes a routine the same as the routine in accordance with the steps S4 through S43 with respect to the fabric W2. When the detected proportion D of the fabric W2 with respect to the second imaging range PE2 is equal to or greater than the predetermined value A, the CPU 86 outputs a setting completion signal indicative of the completion of setting of the fabric W2 to the main CPU 81.

The main CPU 81 actuates the third electromagnetic change-over valve 73 to move the indicator 53 into the elevated position in a step S45. Further, the main CPU 81 instructs the CPU 86 to execute a control process for aligning outer profile lines with respect to the second fabric W2 in a step S46, and executes a control process for aligning outer profile lines (see FIG. 10) with respect to the first fabric W1 in a step S47.

Figure 14:
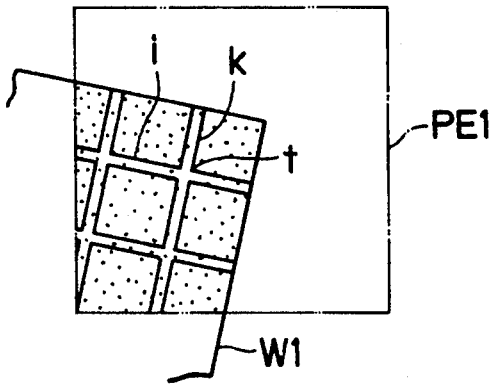
FIG. 14 is a diagram showing the relationship between the positions of an imaging range and a fabric set in place.
Figure 15:
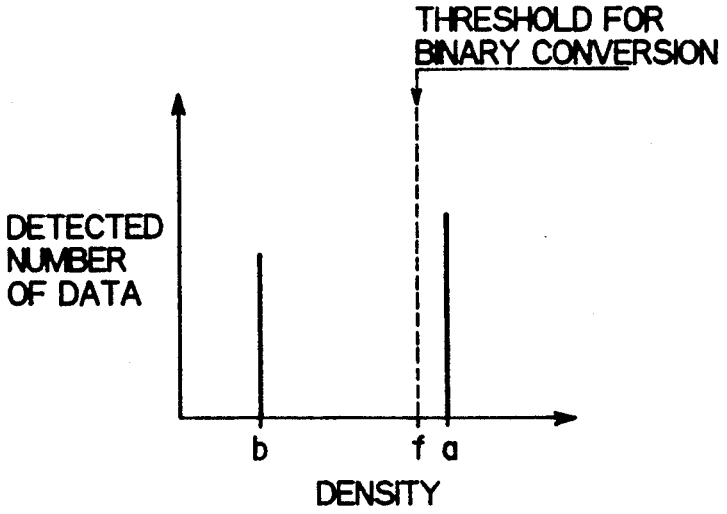
FIG. 15 is a diagram showing the relationship between densities and detected number of image data of a detected separator plate and fabric with consideration of threshold level.

The control process S47 for aligning outer profile lines of the fabric W1 will be described below with reference to FIGS. 14 through 19. Incidentally, the control process for aligning outer profile lines of the fabric W2 is the same as the control process for aligning outer profile lines of the fabric W1, and will not be described below. The image data of the fabric W1 set as shown in FIG. 14, within the first imaging range PE1, is read and stored in the image data memory or the RAM 83 in a step S60. The image data is then converted into binary data, using, as a threshold value, density "f" that is slightly lower than the highest density "a" corresponding to the separator plate 49, as shown in FIG. 15, thus determining a detected region of the fabric W1 which is shown hatched in FIG. 16, in a step S61. The density of the fabric W1 is indicated by "b" in FIG. 15. Then, each item of the density data stored in the image data memory of the RAM 83 is two-dimensionally differentiated using a spatial filter (e.g., a Laplacian filter shown in FIG. 17) composed of a plurality of coefficients, thereby determining image data representative of an outer profile of the fabric W1 as shown in FIG. 18 in a step S62.

Then, in a step 63, are computed two outer profile lines $$y=a_1x+b_1,\ y=a_2x+b_2$$

corresponding to the determined outer profile of the image data in an xy coordinate system in a XY plane described later. More specifically, the equation $y=a_1x+b_1$ is converted into an equation $b_1=-a_1x+y$ according to the Hough transform, and an ab plane is assumed with $a_1$, $b_1$ regarded as variables. In the ab plane, points $(x_1, y_1)$, $(x_2, y_2)$, . . . corresponding to a profile line contained in the xy plane shown in FIG. 18 correspond respectively to a "slope" and an "intercept," and hence there is a straight line existing for each of the points. Based on a point (a, b) where the straight lines intersect, the slope a and the intercept b can be determined in the xy plane.

Likewise, if there are two straight lines in the xy plane, there are two points of intersection of straight lines in the ab plane. Two outer profile lines in the xy plane can be determined from these two points of intersection.

Figure 19:
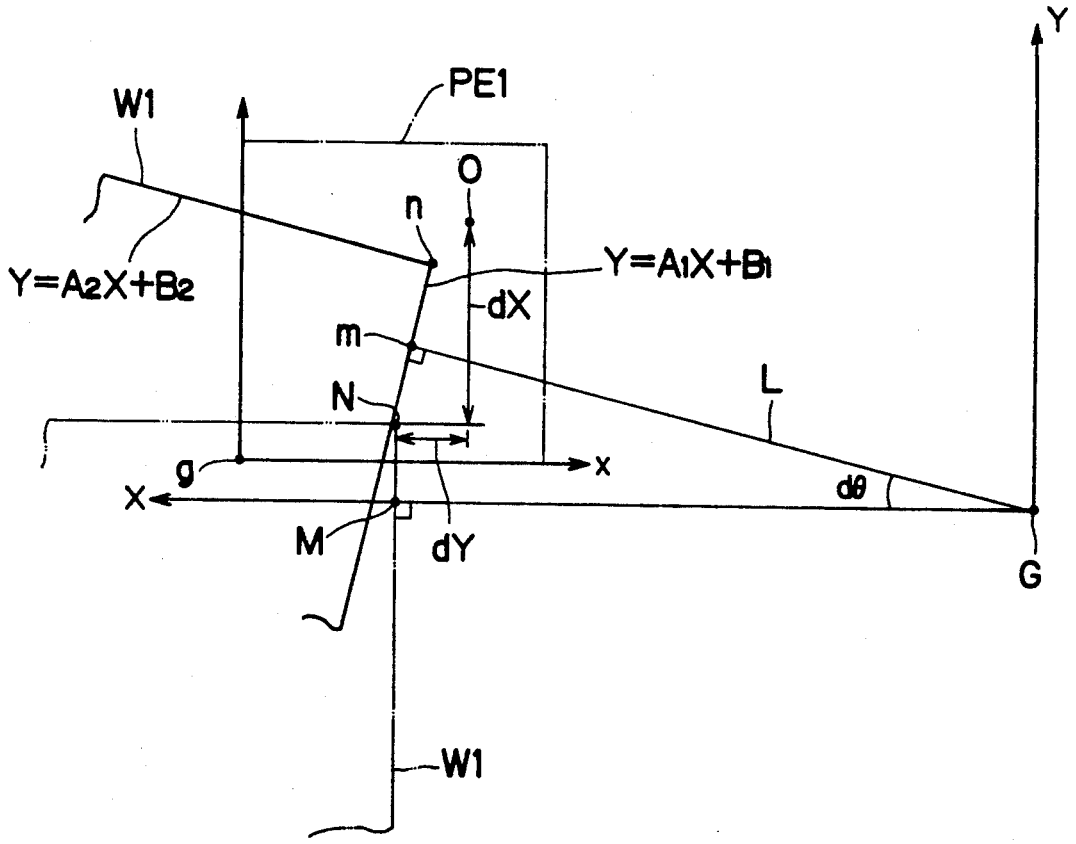
FIG. 19 is a diagram showing the manner in which two outer profile lines at a corner of a fabric are determined for the purpose of angular movement of the fabric.

Then, a deviating or error distance and deviating or error angle are calculated in a step S64 to correct the position of the fabric W1 into a preset position in which the corner of the fabric W1 agrees with a reference position 0 $(X_0, Y_0)$ in an XY plane (described later on) taking a sewing margin into account and also in which the outer profile line $y=a_1x+b_1$ extends parallel to the Y direction. Specifically, as shown in FIG. 19, the two profile lines $y=a_1x+b_1$, $y=a_2x+b_2$ are transformed from the xy coordinate system which has an origin g in the first imaging range PE1 into an XY coordinate system which has an origin G about which the first holder 47 is rotatable, thus determining transformed profile lines $Y=A_1X+B_1$, $Y=A_2X+B_2$. The error angle $d\theta$ and the error distance dX, dY which are necessary for positional correction are determined as follows:

As shown in FIG. 19, a point m on the profile line $Y=A_1X+B_1$ is a point of intersection between the profile line $Y=A_1X+B_1$ and a line L perpendicular thereto and extending from the origin G. A point n is a point of intersection between the profile lines $Y=A_1X+B_1$ and $Y=A_2X+B_2$. A position in which the fabric W1 is first set is indicated by the solid line, and an imaginary position which is achieved by the fabric W1 after having been angularly moved counterclockwise from the solid-line position by an error angle $d\theta$ is indicated by the two-dot-and-dash line. Therefore, the coordinates $(X_n, Y_n)$ of the point n are determined from the two profile lines $Y=A_1X+B_1$, $Y=A_2X+B_2$. Since the line L extends perpendicularly to the profile line $Y=A_1X+B_1$ and passes through the origin G, the line L is expressed by $Y=-X/A_1$, allowing the coordinates $(X_m, Y_m)$ of the point m to be determined. The error angle $d\theta$ can be determined from the slope $A_1$ of the line L. The coordinates $((Xm^2+Ym^2)^{\frac{1}{2}}, 0)$ of a point M are determined using the coordinates (Xm, Ym) of the point m. The coordinates (XN, XY) of a point N are indicated by $XN=Xn\cos(d\theta)-Yn\sin(d\theta)$, $YN=Xn\sin(d\theta)+Yn\cos(d\theta)$ using the coordinates (Xn, Yn) of the point n, and hence $dX=Xo-XN$, $dY=Yo-YN$.

Finally, a distance DX in the X direction and a distance DY in the Y direction from the reference position 0 to a stitching position are computed in a step S65. When a signal indicative of the completion of computation of the error distance with respect to the fabric W2 is inputted from the CPU 86 (step S48: Yes), the motors 29, 30, 35, 36, 41, 42 are energized based on the error distance dX in the X direction, the error distance dY in the Y direction, and the error angle $d\theta$ with respect to the fabrics W1, W2 to correct the positions of the fabrics W1, W2 in a step S49. Furthermore, based on the distance DX in the X direction and the distance DY in the Y direction, the motors 29, 30, 35, 36 are energized to move the fabrics W1, W2 to the stitching position in a step S50. Then, the control process is brought to an end.

The above positional control process has been described with respect to the fabrics whose outer profile lines are straight. In the case where a profile line of a fabric is a curved line, an error angle and an error distance between a curved line determined based on image data and a curved line in a preset position can be determined. Simply by varying the reference position 0 depending on the sewing margin, the distance DX for the fabric to be moved in the X direction with the sewing margin taken into account can be determined, thus allowing the sewing margin to be easily altered. Furthermore, simply by varying the reference position of the fabric W1 or the reference position of the fabric W2, the relative position between the fabrics W1, W2 can easily be varied and set.

Figure 20:
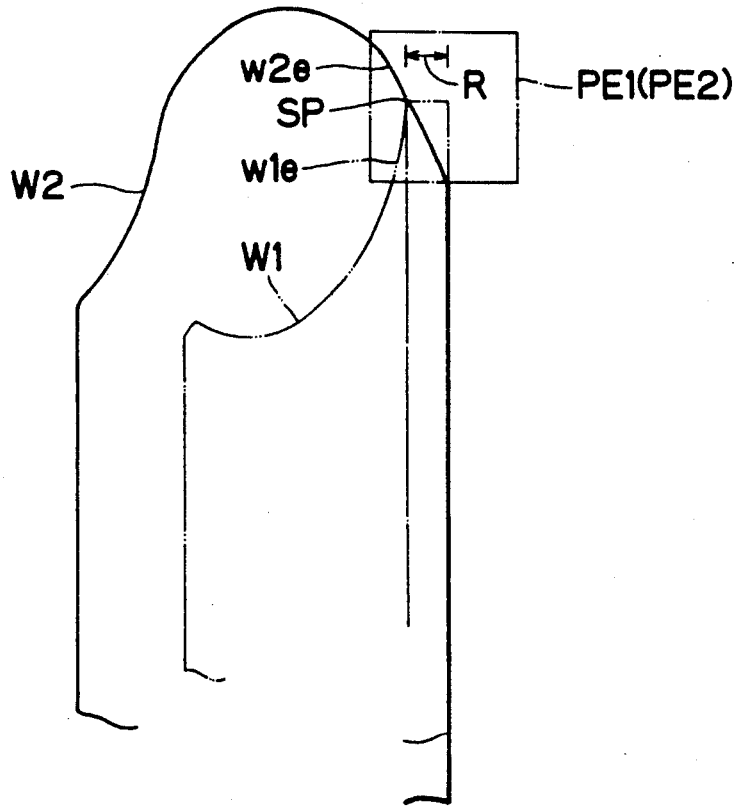
FIG. 20 is a view showing the manner in which a valley sleeve and a mountain sleeve are brought into alignment with each other taking sewing margins thereof into account.

As shown in FIG. 20, it is possible to stitch two different sized fabrics at an intended sewing marginal position SP with maintaining a given sewing margin R, while these fabrics are being kept in positional alignment. Assuming that one fabric W1 is a valley sleeve indicated by the two-dot-and-dash line and another fabric W2 is a mountain sleeve indicated by the solid line. In such a case, it is possible to determine a sewing margin position SP on an outer profile line w1e of the valley sleeve W1 and a sewing margin position SP on an outer profile line w2e of the mountain sleeve W2 based on the profile line data and sewing margin data of the valley sleeve W1 and the mountain sleeve W2 in the imaging regions PE1, PE2. Then, it is possible to determine distances DX, DY in the X and Y directions up to a stitching position based on the sewing margin position SP thus determined.

Figure 21:
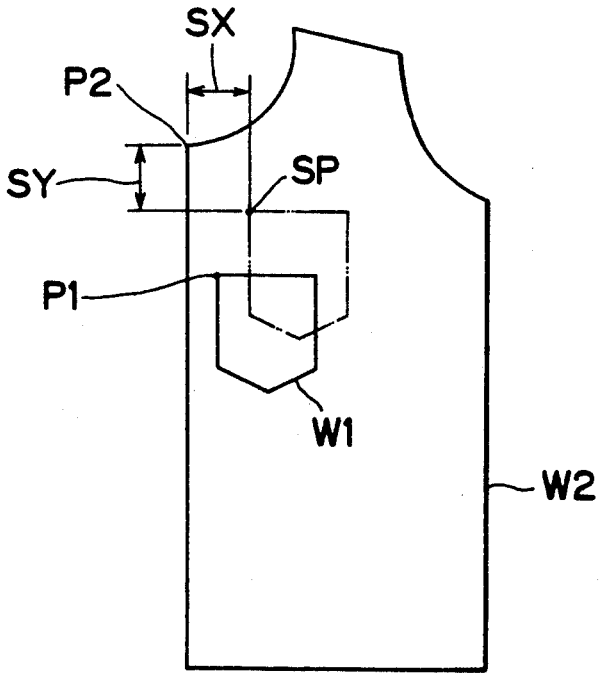
FIG. 21 is a view showing the manner in which a pocket piece is positionally corrected so that it is brought into a relative position with respect to a front garment.

As shown in FIG. 21, if the fabric W1 is a pocket piece and the fabric W2 is a front garment, the pocket piece W1 can be positionally corrected so that it can be positioned in a relative position indicated by the two-dot-and-dash line with respect to the front garment W2. In this case, first, the coordinates of a reference point P2 of the front garment W2 and a reference point P1 of the pocket piece W1 are respectively computed. Then, it is possible to move the pocket piece W1 to the relative position SP with respect to the front garment W2 based on the reference points P1, P2 and distances SX, SY from the reference point P2 to a relative position SP. Even if the outer profile lines of the pocket piece W1 including the reference point P1 and the front garment W2 including the reference point P2 are curved lines, for example, other than straight lines, it is possible to compute an error distance and an error angle of the curved lines from a preset position.

As described above, according to the first embodiment of the present invention, the positions of the fabrics W1, W2 can be corrected while these fabrics are being held by the respective holders 47, 48. That is, outer profiles of these fabrics are detected by the image sensors 50, 51 which can produce image data, so that error distance and error angle of the fabrics from the preset positions can be computed. These fabrics W1, W2 are moved by these holders so as to eliminate the error distance and error angle. Therefore, even if the outer profile lines are straight lines or any of various shape other than straight lines, any positional errors of the fabrics can accurately and reliably be corrected. Further, since the preset position can be selected easily taking the sewing margin into account, sewing margins can easily be altered.

Further, the first embodiment particularly offers the advantage in case of relative positional correction with respect to two fabrics. That is, the pair of fabric holding means, the pair of second imaging means, and the pair of control means are provided for easily bringing the second fabric into a desired position relative to the first fabric which is also subjected to positional correction. In other words, the fabric position correcting device 20 has a pair of position correcting mechanisms for positionally correcting the two fabrics W1, W2, respectively. Therefore, the procedure for aligning the outer profiles of the two fabrics W1, W2 and sewing them to each other can greatly be simplified. In addition, the fabric W1 or the fabric W2 can easily be corrected in position so that it is placed in a desired relative position with respect to the fabric W2 or the fabric W1 by altering the preset relative position.

Figure 22:
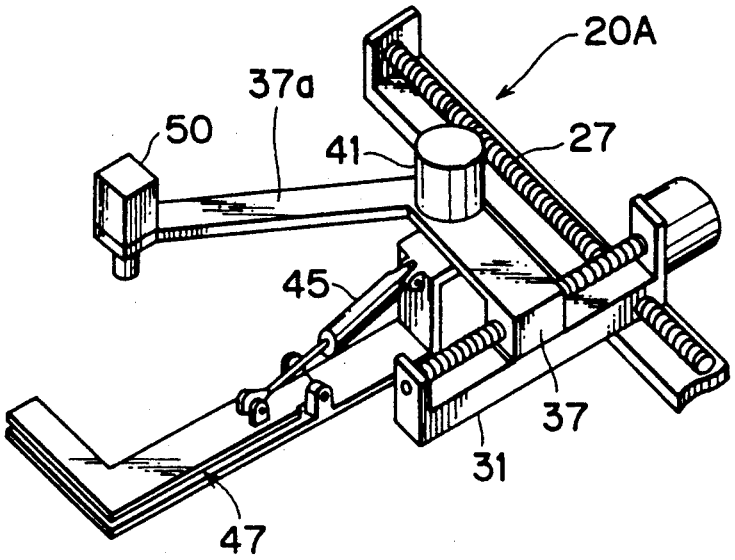
FIG. 22 is a perspective view showing a fabric position correcting device according to one modification.

The fabric position correcting device 20 may be modified such that it corrects the position of a single fabric and feeds the positionally corrected fabric to a stitching position or a predetermined stock position. Moreover, as shown in FIG. 22, a position correcting device 20A may have an arm 37*a* provided integrally with the X direction movable base 37 for supporting the first image sensor 50 on the arm 37*a*.

Figure 23:
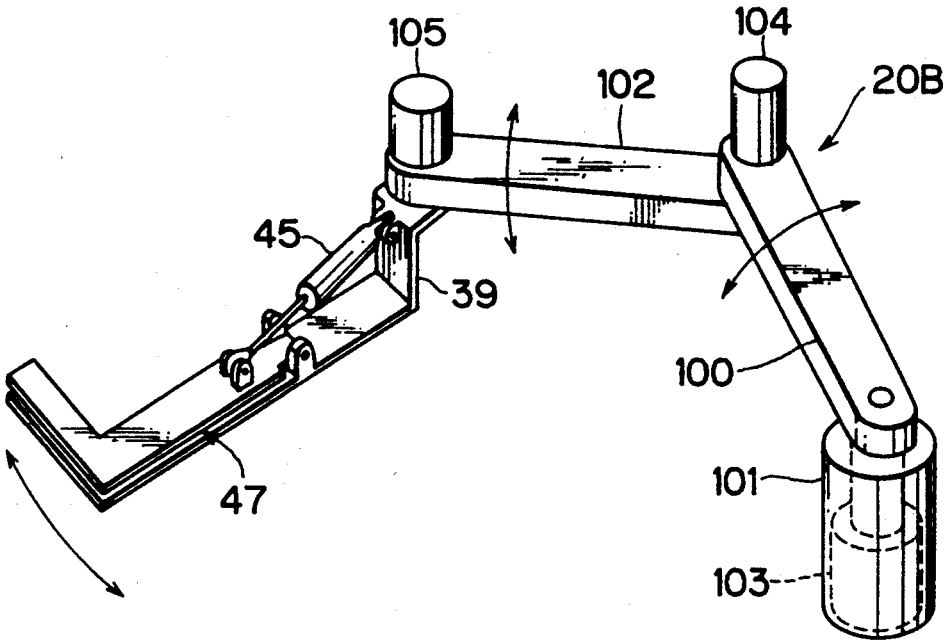
FIG. 23 is a perspective view showing a fabric position correcting device according to another modification.

A position correcting device 20B may be arranged as shown in FIG. 23. A first swing arm 100 has a proximal end horizontally angularly movably mounted on a support member 101 fixed to a machine frame (not shown). A second swing arm 102 has a proximal end horizontally angularly movably mounted on a distal end of the first swing arm 100. A first turn arm 39, which is identical to the first turn arm 39 in the foregoing embodiment, is horizontally angularly movably mounted at its proximal end on a distal end of the second swing arm 102. The support member 101 supports a first turn motor 103 which comprises a stepper motor for turning the first swing arm 100. A second turn motor 104 for turning the second swing arm 102 is mounted on the distal end of the first swing arm 100, and a third turn motor 105 for turning the first turn arm 39 is mounted on the distal end of the second swing arm 102. A first pneumatic cylinder 45 and a first holder 47 are mounted on the first turn arm 39.

With this structure, the movement of the Y-direction movable base 31 (32) and the movement of the X-direction movable base 37 (38) in the foregoing embodiment are substituted by angular movements of the first and second swing arms 100 and 102. Similar to the previous embodiment, an error angle and an error distance of outer profiles from a preset position are computed based on image data from an image sensor which images a corner of a fabric W1. The first, second, and third turn motors 103, 104, 105 are energized based on the computed error angle and error distance. This embodiment offers the same advantages as those of the previous embodiment.

Figure 24:
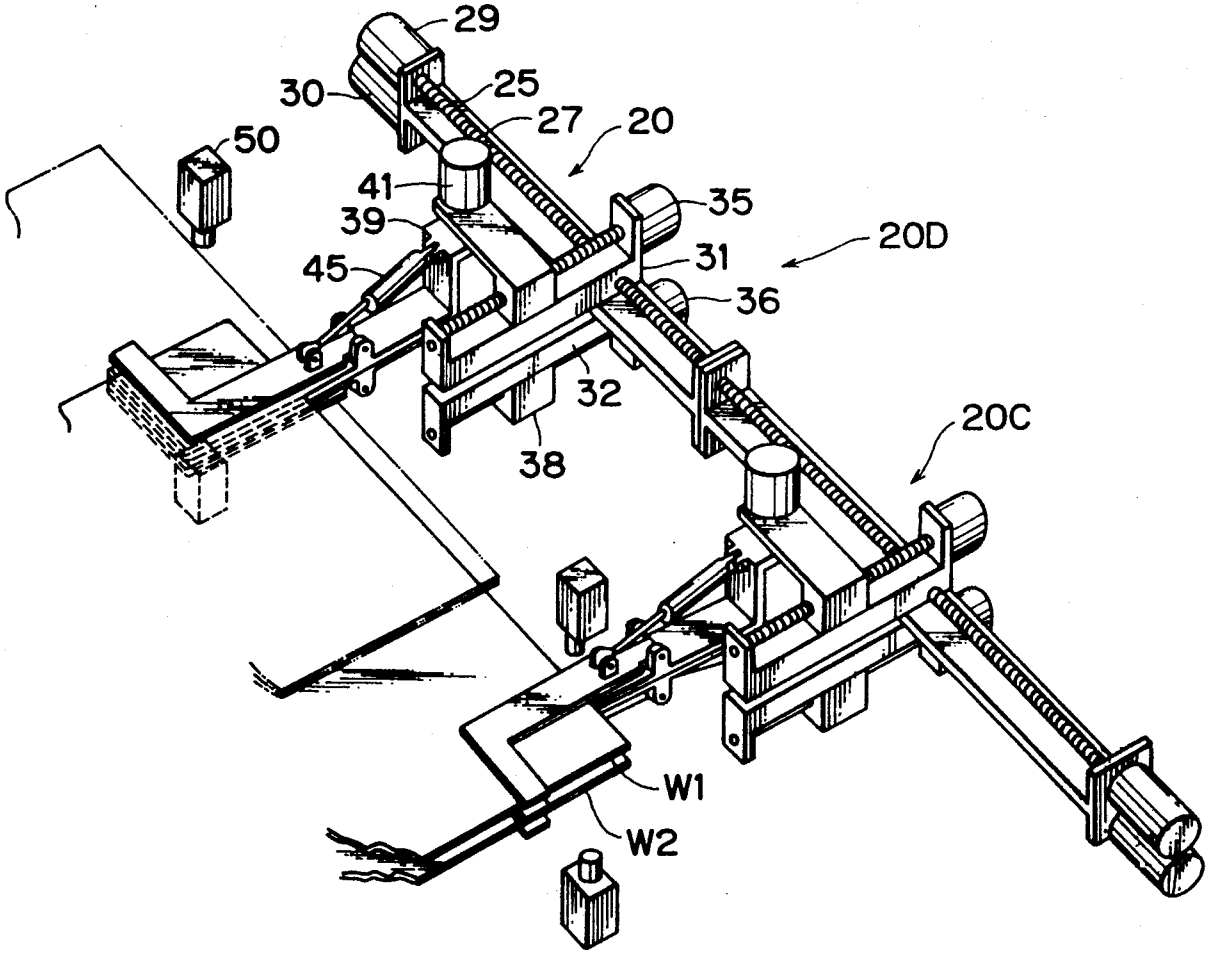
FIG. 24 is a perspective view of showing a fabric position correcting device according to still another modification.

According to still another modification, as shown in FIG. 24, a position correcting device 20D may include the above position correcting device 20 and a position correcting device 20C which is arranged in identical and symmetric relationship to the position correcting device 20. The position correcting device 20 computes error distances with respect to front ends of fabrics W1, W2, whereas the position correcting device 20C computes error distances with respect to rear ends of the fabrics W1, W2. These position correcting devices 20, 20C correct the positions of the fabrics W1, W2, and subsequently move the fabrics W1, W2 to a stitching position or a stock position.

It should be noted that the above described modifications shown in FIGS. 22 through 24 can be applied not only to the above described first embodiment, but also can be applied to second through fourth embodiments described below.

In the fabric position correcting device, at least a portion of the fabric placed in the predetermined imaging range in the horizontal XY plane is imaged by the imaging means, and the image data produced by the imaging means is stored in the memory means. Based on the image data retrieved from the memory means, the processing means detects one of the outer profile line and pattern of the fabric, and compute an error distance in the X and Y directions and an error angle about the vertical axis of the detected outer profile line from a preset position. The control means controls the fabric holding means to hold the fabric, and also controls the actuating means to correct the position of the fabric until the error distance and the error angle as computed by the processing means are eliminated. The actuating means moves the fabric holding means in the X and Y directions in the XY plane and also angularly moves the fabric holding means about the vertical axis for positional correction.

Further, in the fabric position correcting device, a first set of the first fabric holding means, the first actuating means, the first imaging means, the memory means, the processing means, and the first control means operate in the same manner as described above with respect to the first fabric. With respect to the second fabric, a second set of the second fabric holding means, the second actuating means, the second imaging means, the memory means, the processing means, and the second control means operate substantially in the same manner but the second control means controls the second fabric holding means to hold the second fabric, and also controls the second actuating means to bring the second fabric into a preset position relative to the first fabric based on the outer profile line of the second fabric as detected by the processing means. Therefore, even if the outer profile lines of the fabrics are of any of various shapes other than a linear shape, the fabrics held by the respective fabric holding means can be corrected in positions accurately and reliably. The preset position is selected taking a sewing margin into account, thus allowing the sewing margin to be altered easily.

A fabric position correcting device according to a second embodiment of this invention will next be described with reference to FIGS. 1 through 4, 14, 16 through 19, and 25 through 34.

In the second embodiment, patterns of the two fabrics are taken into consideration in addition to the outer profiles thereof. That is, in the second embodiment, the present invention is applied to a fabric position correcting device for feeding two fabrics with the same pattern (striped pattern) drawn thereon, to a stitching position where the fabrics can be sewn on a sewing machine, while aligning the fabrics with respect to patterns of the two fabrics as well as outer profile lines thereof.

A hardware of the second embodiment is the same as that of the first embodiment shown in FIGS. 1 through 4. Further, the image sensors 50, 51 such as those used in the first embodiment serve to detect color densities of own colors of the fabrics W1, W2 and color densities of striped pattern formed thereon. The image signals generated from the sensors and indicative of the color densities of the fabrics and patterns are converted into image data corresponding to the pixels of the CCD of the image sensors 50, 51. The data represent the density of one of successive levels of "0" to "255" for identification of colors.

Regarding control routine of the second embodiment, the steps S2 through S45, and S48 through S50 in the first embodiment are available. However, instead of the steps S46 and S47 of the first embodiment, the following routine are carried out.

Figure 25:
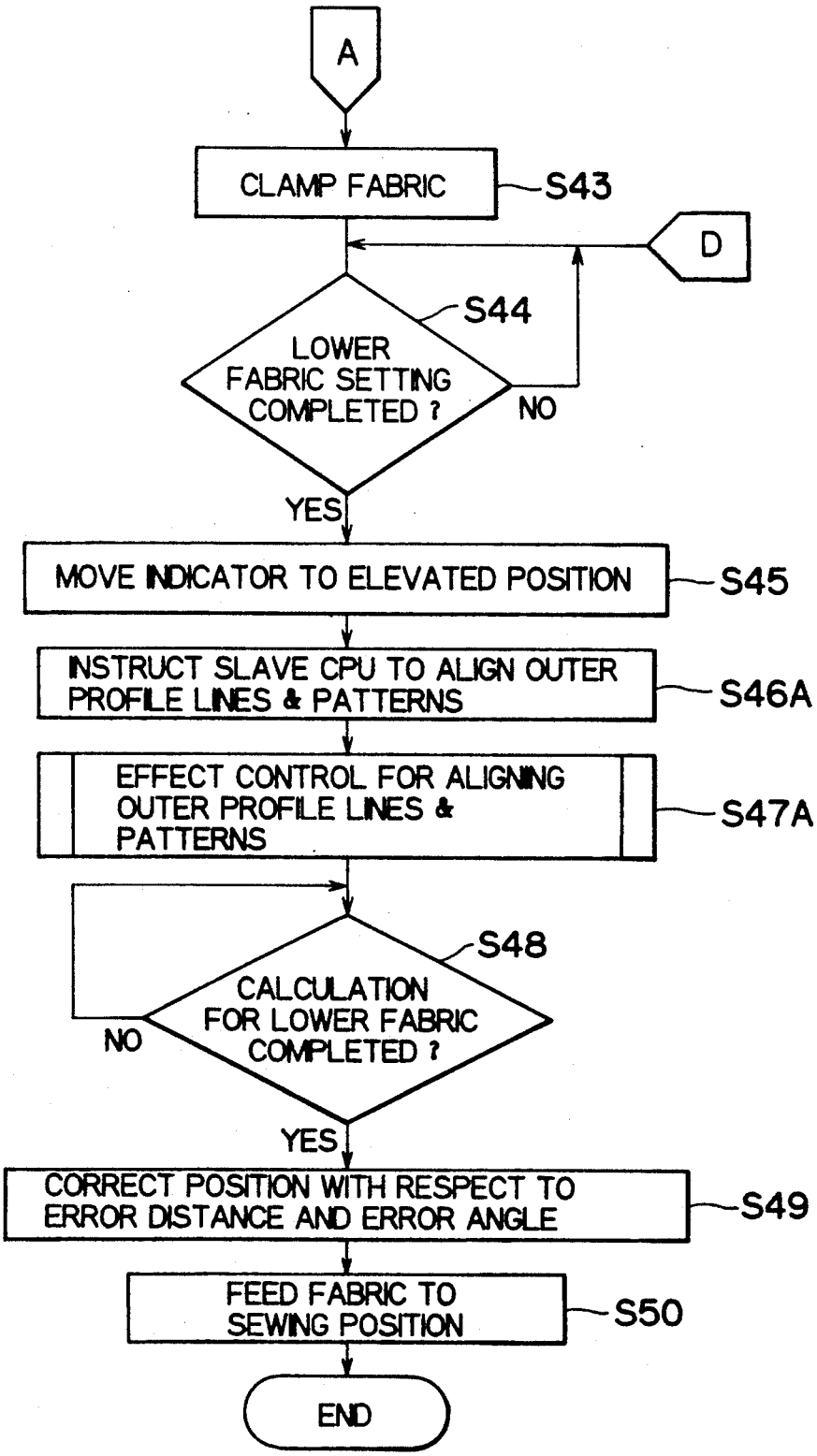
FIG. 25 is a flowchart showing a part of a routine for positional correction control according to a second embodiment of this invention.

In FIG. 25, the main CPU 81 actuates the third electromagnetic change-over valve 73 to move the indicator 53 into the elevated position in the step S45. Further, the main CPU 81 instructs the CPU 86 to execute a control process for aligning the outer profile line and the pattern with respect to the second fabric W2 in a step S46A, and executes a control process for aligning outer profile lines and patterns with respect to the first fabric W1 in a step S47A as described in detail in FIG. 26.

The control process S47A for aligning outer profile line and pattern of the fabric W1 will be described below with reference to FIGS. 14, 16 through 19 and 27. Incidentally, the control process for aligning outer profile line and pattern of the fabric W2 is the same as the control process for aligning outer profile line and pattern of the fabric W1, and will not be described below.

Figure 27:
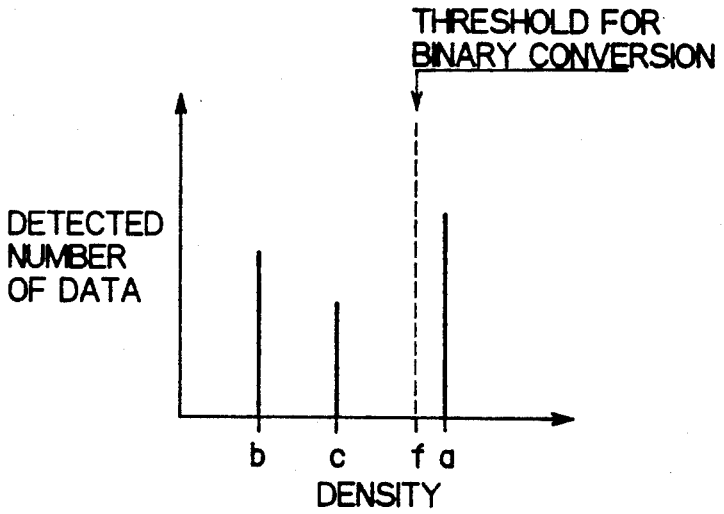
FIG. 27 is a graphical representation showing the relationship between densities and detected numbers of image data of a detected separator plate, fabric and patterns on the fabric with consideration of threshold levels.
Figure 28:
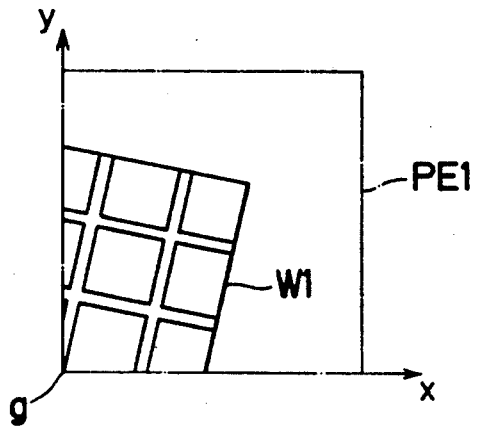
FIG. 28 is a diagram showing the relationship between the position of an imaging range and a pattern of a fabric set in place.
Figure 29:
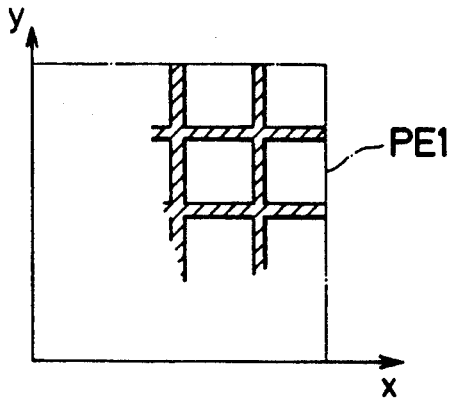
FIG. 29 is a diagram showing coordinate transformation of striped pattern lines in a xy plane.

The image data of the fabric W1 set as shown in FIG. 14, within the first imaging range PE1, is read and stored in the image data memory or the RAM 83 in a step S80. The image data is then converted into binary data, using, as a threshold value, density "f" that is slightly lower than the highest density "a" corresponding to the separator plate 49, as shown in FIG. 27, thus determining a detected region of the fabric W1 which is shown hatched in FIG. 16, in a step S81. The density of the fabric W1 is indicated by "b", and density of the pattern (striped pattern) is indicated by "c" in FIG. 27. Then, each item of the density data stored in the image data memory of the RAM 83 is two-dimensionally differentiated using a spatial filter (e.g., a Laplacian filter shown in FIG. 17) composed of a plurality of coefficients, thereby determining image data representative of an outer profile of the fabric W1 as shown in FIG. 18 in a step S82. Subsequent steps S83 and S84 are the same as the steps S63 and S64 (FIG. 10) in the first embodiment.

Next, in order to correct relative positional error of the two fabrics W1,W2 with respect to the striped pattern, the image data of the fabric W1 as depicted in FIG. 27 are again fetched in a step S85. On a basis of the image data, in a step S86, the binary data using, as the threshold value, the density "f" that is slightly lower than the highest density "a" corresponding to the color of the separator plate 49, and another binary data using as a threshold value, a density which is slightly lower than the density "c" corresponding to the color of the striped pattern are used for obtaining another image data indicative exclusively of the striped pattern. Resultant pattern image data is represented in a xy coordinate shown in FIG. 28.

Figure 30:
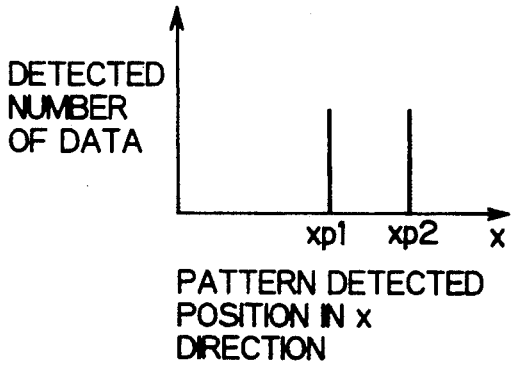
FIG. 30 is a diagram showing a detected position of the striped pattern in x axis.
Figure 31:
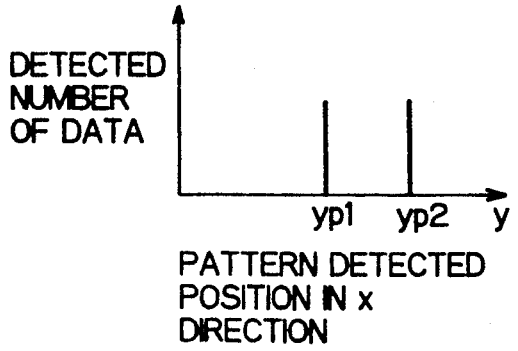
FIG. 31 is a diagram showing a detected position of the striped pattern in y axis.

Then, as shown in FIG. 21, coordinate transformation is effected to the image data in a step S87 so that the image data is rotated by the error angle $d\theta$ which has been obtained in the step S84 and the corner portion is coincident with the corner of the imaging region PE1. Further, pattern position (xp1, xp2) in x direction relative to the X axis and (yp1, yp2) in y direction relative to the Y axis are obtained as shown in FIGS. 30 and 31, respectively. Furthermore, in order to align the pattern position of the fabric W2 with respect to the pattern position of the fabric W1, error distance (dX, dY) and error angle $d\theta$ such as those obtained in the step S84 are applicable with respect to the fabric W1. Regarding the fabric W2, resultant error distance (dX, dY) and error angle $d\theta$ are computed in a step S88 on a basis of the error distance and error angle obtained in the Step S84 and the error distance of the striped pattern. Then, computed is the moving distance DX in X direction and DY in Y direction from the reference position 0 to the stitching position in a Step S89, and the sub-routine is ended and returned to the main routine. Accordingly, the outer profiles of the fabrics W1, W2 are approximately aligned with each other. Further, computation is carried out such that the striped pattern position (xp1, yp1) positioned closest to the corner of the fabric W1 and the stripped pattern position (xp2, yp2) positioned closest to the corner of the fabric W2 can be aligned with each other for correcting relative position with respect to the striped pattern.

Figure 32:
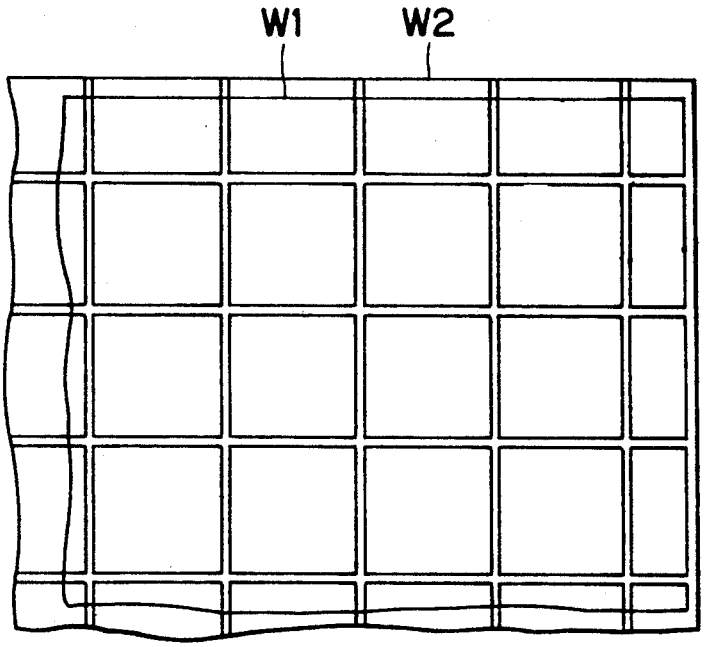
FIG. 32 is a plan view showing two fabrics having patterns identical with each other, and showing a state where the two fabrics are aligned with each other with respect to outer profile lines and pattern.

When a signal indicative of the completion of computation of the error distance with respect to the fabric W2 is inputted from the CPU 86 (step S48: Yes), the motors 29, 30, 35, 36, 41, 42 are energized based on the error distance dX in the X direction, the error distance dY in the Y direction, and the error angle $d\theta$ with respect to the fabrics W1, W2 to correct the positions of the fabrics W1, W2 in a step S49 with respect to the outer profiles and patterns of these fabrics. Furthermore, based on the distance DX in the X direction and the distance DY in the Y direction, the motors 29, 30, 35, 36 are energized to move the fabrics W1, W2 to the stitching position in a step S50. Then, the control process is brought to an end. For example, as shown in FIG. 32, the relative positions of the two fabrics W1 and W2 undergo correction with respect to the outer profiles and patterns at the stitching position.

Figure 33:
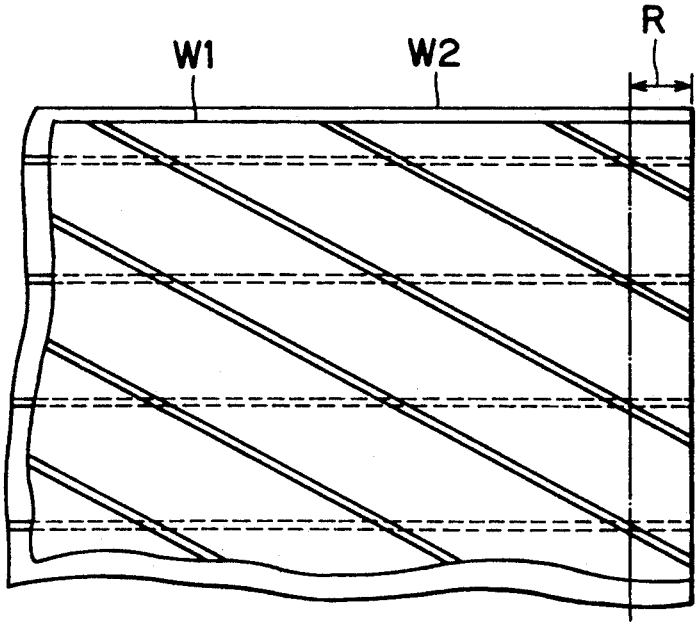
FIG. 33 is a plan view showing two fabrics having patterns different from each other, and showing a state where the two fabrics are aligned with each other with respect to outer profile lines and pattern.

Incidentally, in accordance with the second embodiment, as shown in FIG. 33, in case a fabric W1 having a bias pattern (slanted striped pattern) is to be stitched to a fabric W2 having horizontally extending striped pattern at a stitching line shown by a dotted chain line which extends in parallel with the outer profile lines of the fabric, it is possible to align the two different patterns at the stitching line taking a sewing margin R into account. In this case, error distance and the error angle to the stitching position is computed taking the sewing margin R into account with respect to the fabric W2. On the other hand, regarding the fabric W1, the error distance and the error angle to the stitching position is computed similar to the computation as to the fabric W2 for computing resultant error distance and error angle taking into consideration an aligning point on the bias pattern with the sewing margin R into account and the error distance relative to the horizontally extending striped pattern. The two fabrics W1, W2 are moved to the stitching position with eliminating the resultant error distance.

Moreover, if a fabric W1 is a front garment having a bias pattern, and a fabric W2 is a rear garment having a reversed biased pattern, it is possible to align these fabrics with each other so that the two biased patterns provide symmetrical V-shape at the stitching line while outer profiles of these two fabrics are aligned with each other.

Figure 34:
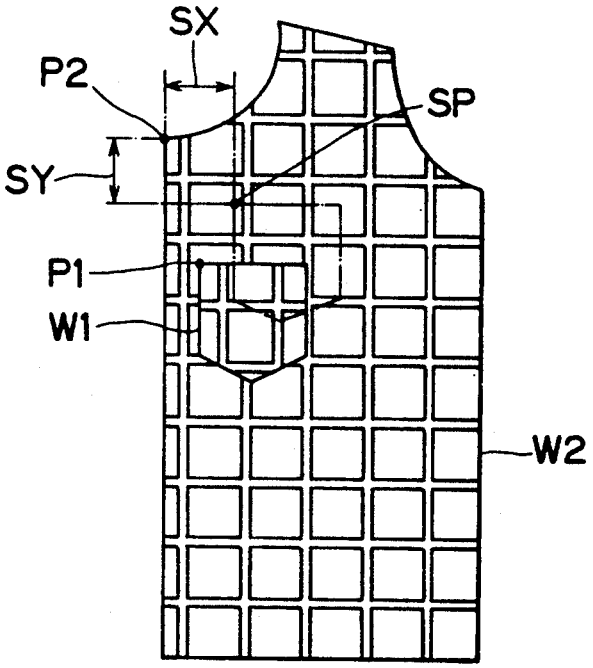
FIG. 34 is a plan view showing two fabrics having patterns identical with each other, and showing a state where the two fabrics are aligned with each other with respect to outer profile lines and patterns at a predetermined relative position.

Further, more, as shown in FIG. 34, if a pocket cloth W1 having a striped pattern is to be stitched to a front garment W2 having an identical striped pattern at an intended portion indicated by two dotted chain line, the pattern of the pocket cloth W1 can be aligned with the pattern of the front garment W2 at a position adjacent to the intended stitching portion. For this, coordinates of a reference point P2 of the front garment W2 and a reference point P1 of the pocket cloth W1 are obtained. Then, the position of the pocket cloth W1 is corrected relative to the front garment W2 to a predetermined relative position SP in terms of the outer profile of the pocket cloth W1 on a basis of the points P1, P2 and distances SX, SY between the reference point P2 and the predetermined relative position SP. Further, the position of the pocket cloth W1 is again corrected taking a computed error distance in terms of the striped pattern.

As described above, according to the second embodiment of this invention, while the fabrics W1 and W2 are held by the first and second fabric holders 47, 48, relative position of the fabrics W1, W2 can be corrected by eliminating the error distance and error angle from the preset position in terms of the outer profile lines and patterns of these fabrics which are detected from image data through picked up image signals. Accordingly, in the second embodiment, relative position of the fabrics can be corrected at high accuracy taking the outer profile lines and patterns of the fabrics.

Further, the second embodiment particularly offers the advantage in case of relative positional correction with respect to two fabrics in view of the outer profile lines and patterns thereof. That is, the pair of fabric holding means, the pair of second imaging means, and the pair of control means are provided for easily bringing the second fabric into a desired position relative to the first fabric which is also subjected to positional correction. In other words, the fabric position correcting device 20 has a pair of position correcting mechanisms for positionally correcting the two fabrics W1, W2, respectively. Therefore, the procedure for aligning the outer profiles and patterns of the two fabrics W1, W2 and sewing them to each other can greatly be simplified. In addition, the fabric W1 or the fabric W2 can easily be corrected in position so that it is placed in a desired relative position with respect to the fabric W2 or the fabric W1 by altering the preset relative position.

Moreover, in the second embodiment, since the image sensors 50, 51 pick-up the color image, pattern of the identical color can be detected at high accuracy, to thereby greatly improve the pattern alignment. Incidentally, the modified arrangements those shown in FIGS. 22 through 24 are available for alignments of the fabrics in terms of both the outer profiles and patterns thereof.

A fabric position correcting device according to a third embodiment of this invention will next be described with particular reference to FIGS. 1 through 3, and 35 through 38.

Figure 35:
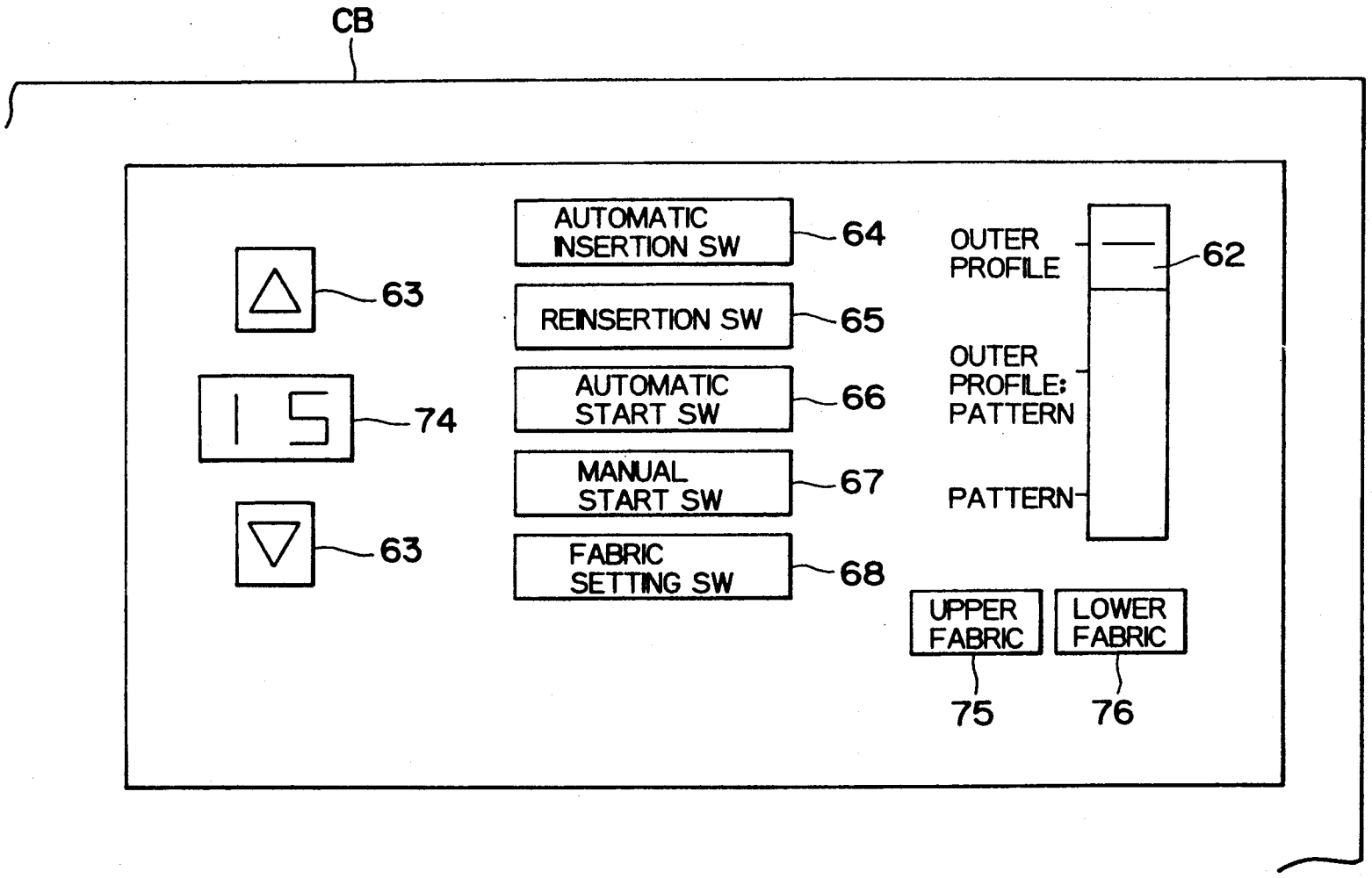
FIG. 35 is an enlarged fragmentary front elevational view showing a control box according to a third (and fourth) embodiment of this invention.

The third embodiment provides a hardware substantially the same as the foregoing embodiments. In the third embodiment, alignment of the fabrics can be selectively performed either in terms of outer profile or patterns thereof, or both. For this, as shown in FIGS. 3 and 35, a selection switch 62 is further provided. The selection switch 62 is connected to the input port 80 of the controller C, and is adapted to select operation mode among outer profile alignment, outer profile/pattern alignment, and pattern alignment for facilitating fabric alignment at a desired location.

Figure 36:
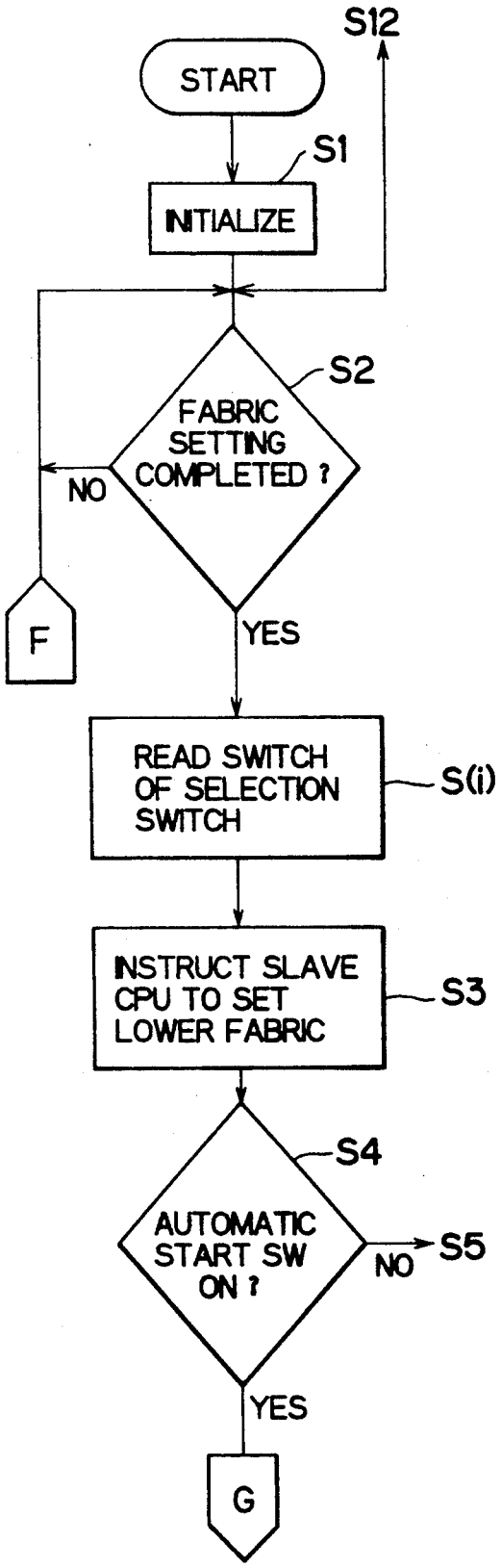
FIGS. 36 and 37 are flowcharts each showing a part of a routine for positional correction control according to a third embodiment of this invention.

According to a control routine in the third embodiment, steps S1 through S50 and steps S60 through S64 in the first and second embodiments, and steps S80 through S88 in the second embodiment are available. Further, as shown in FIG. 36, a step S(i) is further achieved after the step S2 and prior to the step S3. In the step S(i), switch signal is read which is provided in accordance with the selection of the operation mode.

Figure 37:
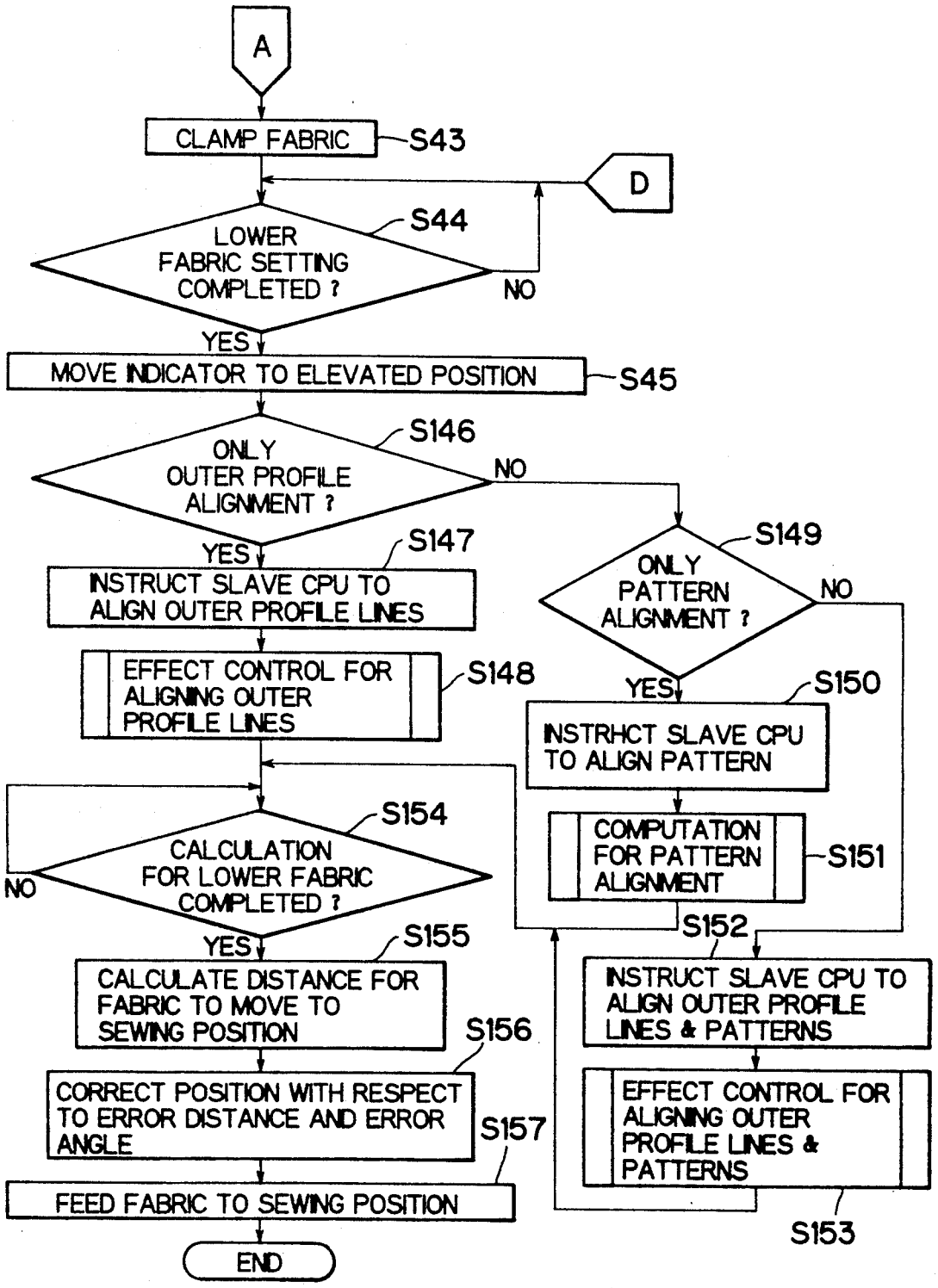
Figure 38:
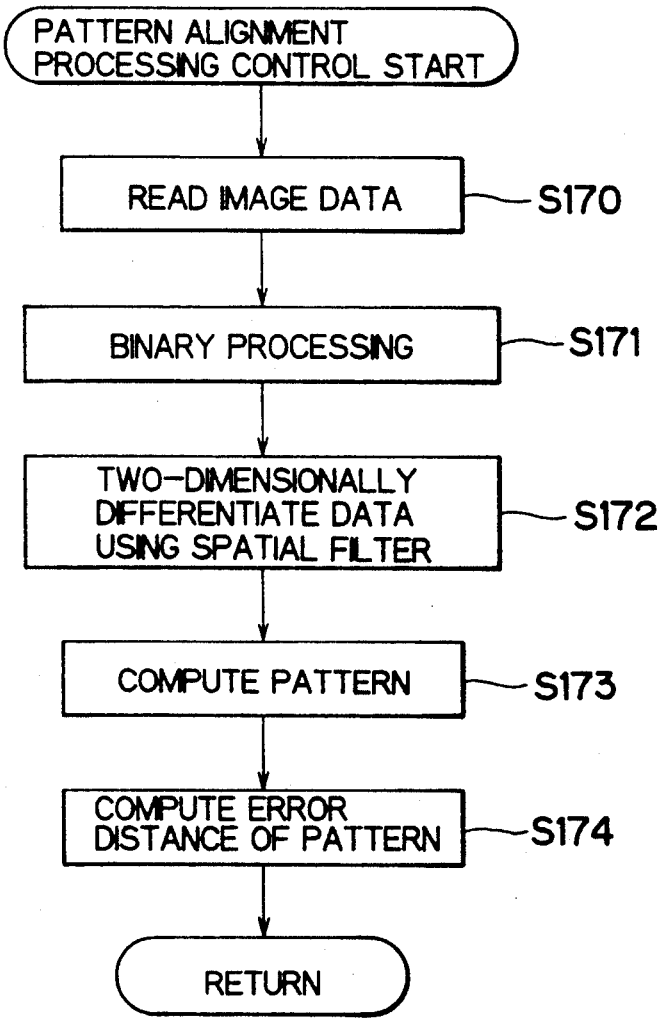
FIG. 38 is a flowchart showing a sub-routine in the third embodiment.

In FIG. 37, after the main CPU 81 actuates the third electromagnetic change-over valve 73 to move the indicator 53 into the elevated position in the step S45, judgment is made in steps S146 and S149 as to which one of the operation mode is selected by the selection switch 62 in accordance with the switch signal generated therefrom. If the alignment is to be carried out in accordance with the outer profile line of the fabrics (S146; Yes), the main CPU 81 instructs the slave CPU 86 to execute the control process for aligning outer profile lines with respect to the second fabric W2 in a step S147, and executes the control process for aligning outer profile lines (FIG. 10) with respect to the first fabric W1 in a step S148 (steps S60 through S64).

On the other hand, if the alignment is to be carried out in accordance with the patterns of the fabrics (S146: No, S149: Yes), the main CPU 81 instructs the slave CPU 86 to execute the control process for aligning pattern with respect to the second fabric W2 in a step S150, and executes the control process for aligning pattern (FIG. 38) with respect to the first fabric W1 in a step S151. Further, if the alignment is to be carried out in accordance with both the outer profiles and patterns of the fabrics (S146 S149: No), the main CPU 81 instructs the slave CPU 86 to execute the control process for aligning outer profile and pattern with respect to the second fabric W2 in a step S152, and executes the control process for aligning outer profile line and pattern (FIG. 26) with respect to the first fabric W1 in a step S153 (steps S80 through S88).

In case of the alignment of the fabrics with respect to the outer profile lines thereof, the steps the same as the steps S60 through S64 are carried out. If the steps S64 is finished, the sub-routine is returned to the main routine.

Regarding alignment of the fabrics with respect to the patterns thereof, the control process is approximately similar to that in case of the alignment with respect to the outer profile line. A control to the pattern alignment for the fabric W1 will be described. Incidentally, the pattern alignment control for the fabric W2 will not be described because of identical control with the control for the fabric W1. First, an image data of the first fabric W1 set at the first imaging area PE1 as shown in FIG. 14 is read in a step S170. Then, in a step S171, on a basis of the image data, the binary data using, as the threshold value, the density "f" that is slightly lower than the highest density "a" corresponding to the color of the separator plate 49, and another binary data using as a threshold value, a density which is slightly lower than the density "c" corresponding to the color of the striped pattern are used for obtaining another image data indicative exclusively of the striped pattern. Then, the routine proceeds into a step S172 where the image data is two-dimensionally differentiated using the spatial filter so as to obtain an image data exclusively concerning an outline of the pattern.

Next, equations of two pattern lines "j" and "k" shown in FIG. 14 are computed in a step S173 in accordance with a procedure the same as that of the outer profile line alignment. Then, in a step S174, error distance (dX, dY) and error angle dθ from the preset position are computed so as to coincide an intersecting point t defined by the pattern lines j and k with a reference position O(Xo, Yo) and so as to direct the pattern line k in parallel with the Y axis direction. Then, the sub-routine is returned the main routine.

Figure 26:
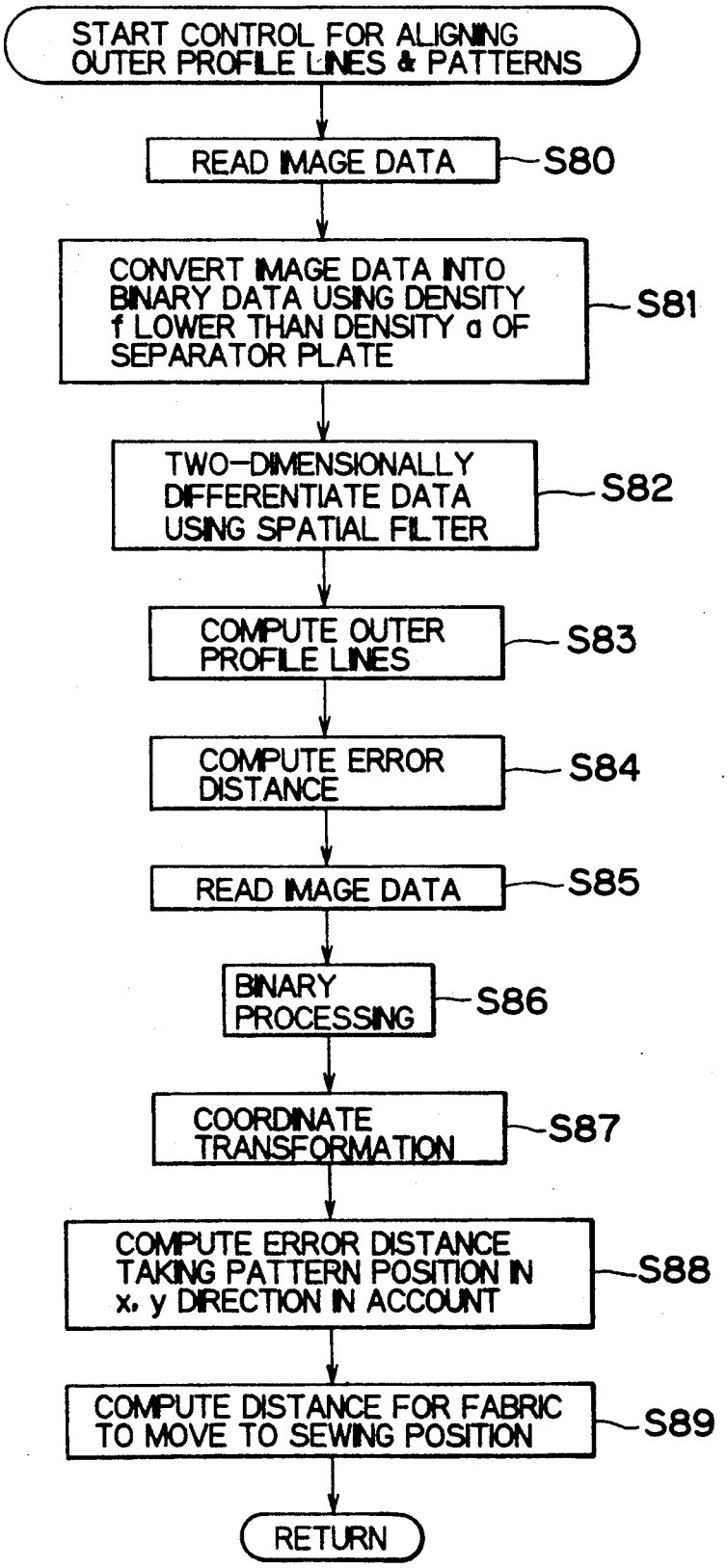
FIG. 26 is a flowchart showing a sub-routine in the second embodiment.

The alignment control with respect to both the outer profile line and the pattern is the same as that described in the second embodiment (FIG. 26). In the third embodiment, after the step S88 is executed, the routine is returned to the main routine (The step S89 in the second embodiment is executed in the main routine in the third embodiment.)

Then, when a signal indicative of the completion of computation of the error distance with respect to the fabric W2 is inputted from the CPU 86 (S154: Yes), moving distance DX in the X direction and DY in the Y direction from the reference position 0 to the stitching position are computed in a step S155. Subsequent steps S156 and S157 are the same as those of the steps S49 and S50. That is, after the step S155, the motors 29, 30, 35, 36, 41, 42 are energized based on the error distance dX in the X direction, the error distance dY in the Y direction, and the error angle dθ with respect to the fabrics W1, W2 to correct the positions of the fabrics W1, W2 in the step S156 with respect to the selected content among the outer profiles and patterns of these fabrics. Further, based on the distance DX in the X direction and the distance DY in the Y direction, the motors 29, 30, 35, 36 are energized to move the fabrics W1, W2 to the stitching position in the step S157.

Here, in the step S156, in order to align the outer profile and pattern position of the fabric W2 with respect to the outer profile and pattern position of the fabric W1, error distance (dX, dY) and error angle dθ such as those obtained in the step S84 are applicable with respect to the fabric W1. Regarding the fabrifc W2, resultant error distance (dX, dY) and error angle dθ are computed on a basis of the error distance and error angle obtained in the Step S84 and the error distance of the striped pattern. The positional correction can be made absed on the error distance and angle.

As described above, according to the third embodiment of this invention, while each of the fabrics are held by the holders 46, 48, relative position of the two fabrics can be corrected at high accuracy so as to eliminate error distance and error angle from the preset position in terms of either outer profiles, patterns or both, in accordance with the operation mode selection by the selection switch 62. This is also advantageous in reducing preparatory period for sewing. Incidentally, the modified embodiments shown in FIGS. 22 through 24 are available in the third embodiment.

Figure 39:
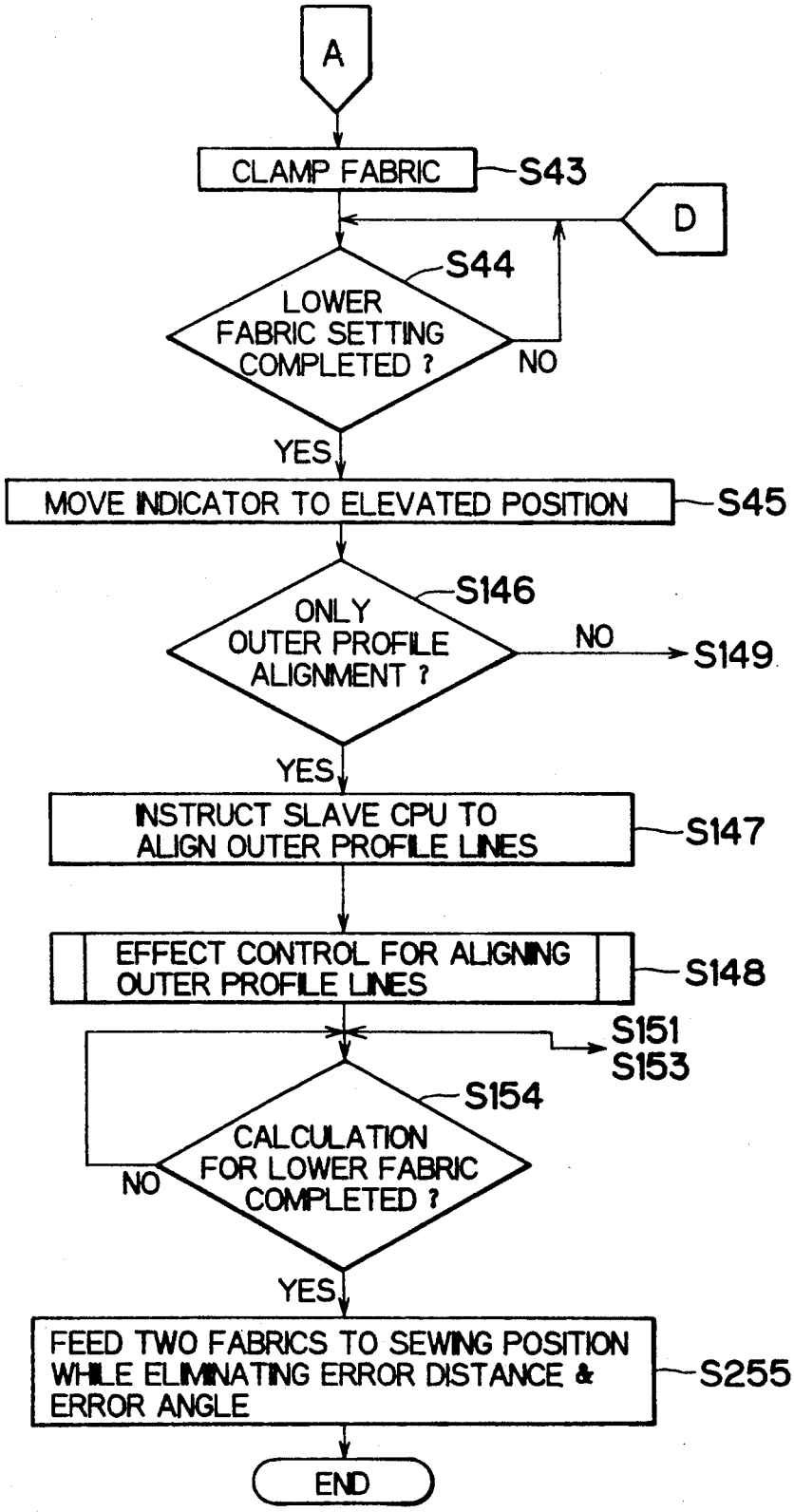
FIG. 39 is a flowchart showing a part of a routine for positional correction control according to a fourth embodiment of this invention.

A fabric position correcting device according to a fourth embodiment of this invention will next be described with particular reference to FIGS. 39 and 40. The fourth embodiment is similar to the third embodiment in terms of alignment control based on the selection of operation modes. However, the fourth embodiment is an improvement on the third embodiment in that the relative positional correction of the two fabrics are carried out during travel of these fabrics to a desired alignment location such as the stitching position. More specifically, turning back to the foregoing embodiments, for example, in the third embodiment, after the relative position of the two fabrics is corrected at the preset position, these fabrics are fed to the desired location such as the stitching position keeping the aligned positional relation (see the steps S156 and S157). On the other hand, in the fourth embodiment, the two steps S156 and S157 are simultaneously performed in a step S255 (FIG. 39) for reducing moving times or frequencies of the fabric holders, to thereby reduce preparatory period prior to the actual sewing operation.

The fourth embodiment provides a hardware the same as that of the third embodiment. Further, the fourth embodiment performs the steps S1 through S45, S146 through S154, S60 through S65, and S80 through S89 those described above.

In other words, in the first and second embodiments, in a case where the stitching position(final alignment position) is regarded as a preset position and the preset position with respect to the reference position 0 assumed in the control process is regarded as a temporary preset position in association with the stitching position, the fabrics W1, W2 may be directly moved to the stitching position while eliminating the error distances based on the distances dX, DX in the X direction and the distances dY, DY in the Y direction. The forth embodiment will achieve this concept.

In the step S65 of the fourth embodiment, a moving distance DX in the X direction and a moving distance DY in the Y direction to a stitching position (final alignment position) are computed on a basis of the preset moving distance from the reference position 0 to the stitching position. When a signal indicative of the completion of alignment with respect to the fabric W2 is inputted from the CPU 86 (step S154: Yes), the motors 29, 30, 35, 36, 41, 42 are energized based on the moving distance DX in the X direction, the moving distance DY in the Y direction, and the error angle dθ with respect to the fabrics W1, W2 in a Step S255. Therefore, the two fabrics W1, W2 can be approximately simultaneously moved to the stitching position while undergoing relative positional correction. Then, the control process is brought to an end.

If the needle bar is subsequently in a position other than the elevated position, the sewing machine motor 10 may be energized to move the needle bar into the elevated position, and the solenoid 11 may be energized to shift the presser bar into the pressing position.

Figure 40:
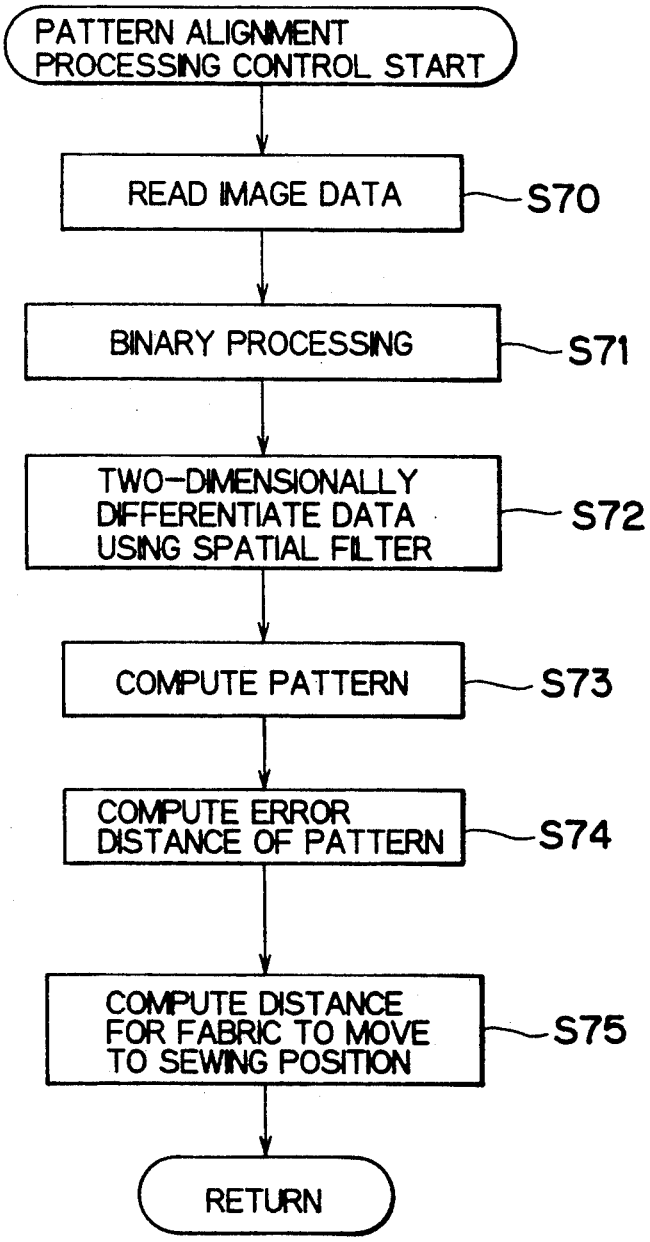
FIG. 40 is a flowchart showing a sub-routine in the fourth embodiment.

In case of the pattern alignment, as shown in FIG. 40, after the step S74 is executed, the routine proceeds to a step S75. In the step S75, a moving distance DX in the X direction and a moving distance DY in the Y direction to the stitching position (final alignment position) are computed on a basis of the preset moving distance from the reference position 0 to the stitching position. When a signal indicative of the completion of alignment with respect to the fabric W2 is inputted from the CPU 86 (step S154: Yes), the two fabrics W1, W2 are respectively and directly fed to the stitching position in the step S255, while simultanelously correcting alingment of the patterns of the two fabrics. Then, the control is ended.

The same is true with respect to the outer profile/pattern alignment. Here, in the step S255, in order to align the outer profile and pattern position of the workpiece W2 with respect to the outer profile and pattern position of the fabric W1, the predetermined moving distance to the stitching position in view of the error distance and error angle such as those obtained in the step S84 is applicable with respect to the fabric W1. Regarding the fabric W2, predetermined moving distance to the stitching position in view of a resultant error distance and error angle, which is computed on a basis of the error distance and error angle obtained in the Step S84 and the error distance of the striped pattern, is applicable. With these application, the fabrics W1, W2 are directly fed to the stitching position while correcting the positional error in terms of outer profiles and patterns of the fabrics, and the control is ended.

As described above, according to the fourth embodiment of this invention, the fabrics are subjected to relative positional alignment in any one of the selected operation mode, i.e., outer profile line alignment mode, pattern alignment mode and both profile and pattern alignment mode, during travel of the fabrics to the stitching position, while being held by the fabric holders 47, 48. Therefore, in the fourth embodiment, the fabrics can promptly reache the stitching position. Incidentally, the modified embodiments shown in FIGS. 22 through 24 are applicable to the fourth embodiment.

While the invention has been described in detail and with reference to specific embodiments thereof, it would be apparent to those skilled in the art that various changes and modifications may be made therein without departing from the spirit and scope of the invention.

What is claimed is:

1. A fabric position correcting device for correcting a position of at least one fabric lying in a horizontal XY plane comprising:

fabric holding means for holding at least a portion of a fabric, the fabric holding means being movable in X and Y directions in the XY plane and also angularly movable about a vertical axis so as to move the fabric to a desired position in the XY plane;

actuating means connected to the fabric holding means for moving the fabric holding means in the XY plane and angularly moving the fabric holding manes about the vertical axis;

imaging means for imaging at least a portion of the fabric which is placed in a predetermined imaging range in the XY plane, the imaging means producing image signals;

memory means connected to the imaging means for storing image data converted from the image signals;

processing means for detecting at least one of an outer profile line and a pattern of the fabric based on the image data retrieved form the memory means and computing an error distance in the X and Y directions and an error angle about a vertical axis extending from the detected one of the outer profile line and the pattern from a preset position;

control means connected to the actuating means for controlling the actuating means to correct the position of the fabric until the error distance and the error angle computed by the processing means are eliminated while the fabric is being held by the fabric holding means; and selection means connected to the memory means for selecting one of detections to be carried out in the processing means among the outer profile line, the pattern of the fabric, and both the outer profile line and the pattern of the fabric.

2. The fabric position correcting device as claimed in claim 1, wherein the fabric holding means comprises:

a support base horizontally extending in the Y direction;

at least one Y-direction movable base slidably movable along the support base and extending in the X direction;

at least one X-direction movable base slidably movable along the Y-direction movable base and extending in the Y direction;

at least one turn arm pivotally supported on the X-direction movable base, the turn arm being pivotally movable in the horizontal XY plane about the vertical axis and the fabric being held at the turn arm.

3. The fabric position correcting device as claimed in claim 2, wherein the turn arm comprises;

a turn arm body pivotally supported on the X-direction movable base;

a holder member lying in the horizontal XY plane and integrally connected to the turn arm body for supporting one surface of the fabric; and a holding member positioned in superposed relation to the holder member and pivotally movable in a vertical direction, the holding member being movably supported to the turn arm body for holding another surface of the fabric.

4. The fabric position correcting device as claimed in claim 3, wherein the actuating means comprises;

at least one first drive motor mounted to the support base for moving the Y-direction movable base in the Y direction;

at least one second drive motor mounted on the Y-direction movable base for moving the X-direction movable base in the X direction; and at least one third drive motor having a motor shaft, the third drive motor being mounted on the X-direction movable base for angularly rotating the turn arm about an axis of the motor shaft.

5. The fabric position correcting device as claimed in claim 4, wherein the actuating means further comprises a pneumatic cylinder connected to the control means and disposed between the turn arm body and the holding member for pivotally moving the holding member toward and away from the holder member, to thereby selectively hold the fabric between the holder member and the holding member.

6. The fabric position correcting device as claimed in claim 1, wherein the imaging means comprises at least one charge coupled device having a plurality of pixels for detecting density at the imaging area and generating the image signals.

7. The fabric position correcting device as claimed in claim 6, further comprising at least one A/D converter for converting the image signals into signals of the image data to be stored in the memory means.

8. The fabric position correcting device as claimed in claim 7, wherein the processing means comprises:

determination means for determining a proportion of an area of the fabric at the predetermined imaging range, and judging whether or not the proportion is greater than a predetermined value; and computing means for computing moving distance in at least one of X and Y directions and angular moving amount about the vertical axis with respect to a reference position.

9. The fabric position correcting device as claimed in claim 8, wherein the control means controls the actuating means for moving the fabric holding means by the computed distance and computed angle in accordance with a result of computation in the computing means.

10. The fabric position correcting device as claimed in claim 9, wherein the reference position serves as a stitched position taking a desired sewing margin into account.

11. The fabric position correcting device as claimed in claim 10, further comprising a support table for supporting the fabric in the horizontal XY plane, and wherein a sewing machine has a frame and a bed at which the stitched position is defined, the support base being supported on the frame, and the support table being positioned at a vertical level the same as that of the bed for feeding the fabric on the support table to the stitched position, the fabric holding means being moved for aligning the position of the fabric when the fabric holding means is positioned above the support table and the aligned fabric being fed to the stitched position.

12. The fabric position correcting device as claimed in claim 2, wherein the fabric holding means further comprises an auxiliary arm horizontally extending from the X direction movable base for supporting the imaging means.

13. The fabric position correcting device as claimed in claim 1, wherein the fabric holding means comprises:

a support member;

a first sewing arm having one end pivotally supported to the support member and having another end, the first sewing arm being pivotally movable in the horizontal XY plane;

a second sewing arm having one end pivotally supported to the other end of the first sewing arm and having another end, the second sewing arm being pivotally movable in the horizontal XY plane;

a turn arm having one end pivotally supported to the other end of the second sewing arm, the turn arm being pivotally movable in the horizontal XY plane about the vertical axis and the fabric being held at the turn arm.

14. The fabric position correcting device as claimed in claim 13, wherein the turn arm comprises;

a turn arm body pivotally supported to the other end of the second sewing arm;

a holder member lying in the horizontal XY plane and integrally connected to the turn arm body for supporting one surface of the fabric; and a holding member positioned in superposed relation to the holder member and pivotally movable in a vertical direction, the holding member being movably supported to the turn arm body for holding another surface of the fabric.

15. The fabric position correcting device as claimed in claim 14, wherein the actuating means comprises:

a first drive motor supported on the support member and connected to the one end of the first sewing arm for angularly rotating the first sewing arm;

a second drive motor mounted on the other end of the first sewing arm and connected to the one end of the second sewing arm for angularly rotating the second sewing arm; and a third drive motor mounted on the other end of the second sewing arm and connected to the turn arm body for angularly rotating the turn arm body.

16. The fabric position correcting device as claimed in claim 15, wherein the actuating means further comprises a pneumatic cylinder connected to the control means and disposed between the turn arm body and the holding member for pivotally moving the holding member toward and away from the holder member, to thereby selectively hold the fabric between the holder member and the holding member.

17. The fabric position correcting device as claimed in claim 16, further comprising a support table for supporting the fabric in the horizontal XY plane, and wherein a sewing machine has a frame and a bed at which a stitched position is defined, the support member being supported on the frame, and the support table being positioned at a vertical level the same as that of the bed for feeding the fabric on the support table to the stitched position, the fabric holding means being moved for aligning the position of the fabric when the fabric holding means is positioned above the support table and the aligned fabric being fed to the stitched position.

18. The fabric position adjusting device as claimed in claim 17, wherein the processing means comprises;

detection means for detecting at least one of the outer profile line and a pattern of the fabric based on the image data retrieved from the memory means in accordance with a result of the selection by the selection means; and computing means for computing the error distance in the X and Y directions and an error angle about the vertical axis of the detected one of the outer profile line, the pattern and the outer profile line/pattern.

19. The fabric position correcting device as claimed in claim 1, wherein the fabric includes first and second fabrics which lie in the horizontal XY plane in a superposed relation, and relative position of the first and second fabrics is to be controlled;

and wherein the holding means comprises first and second fabric holding means for holding at least portions of the first and second fabrics, respectively, the first and second fabric holding means being independently movable in X and Y directions in the XY plane and independently angularly movable about a vertical axis for respectively positioning the first and second fabrics to desired locations;

and wherein the actuating means comprises first and second actuating means connected to the first and second fabric holding means respectively for independently moving first and second fabric holding means in the XY plane and independently angularly moving the first and second fabric holding means about the vertical axis;

and wherein the imaging means comprises first and second imaging means for imaging at least portions of the first and second fabrics which are placed in first and second imaging ranges in the XY plane, the first and second imaging means producing respective independent image signals with respect to the portions of the first and second fabrics.

20. The fabric position correcting device as claimed in claim 19, wherein the memory means is connected to the first and second imaging means for storing image data converted from the image signals, and the processing means detecting at least one of the outer profile lines and patterns of the first and second fabrics based on the image data retrieved from the memory means and computing an error distance in the X and Y directions and an error angle about the vertical axis of the detected one of the outer profile line and the pattern of the first fabric from a preset position, and the control means controlling the first and second actuating means to correct relative positions of the first and second fabrics until the error distance and the error angle computed by the processing means are eliminated while the fabrics are being held by the first and second fabric holding means.

21. The fabric position correcting device as claimed in claim 20, wherein the control means comprises:

first control means for controlling the first actuating means to correct the position of the first fabric until the error distance and the error angle computed by the processing means are eliminated while the first fabric is being held by the first fabric holding means; and second control means for controlling the second actuating means to bring the second fabric into the preset position relative to the first fabric based on at least one of the outer profile line and the pattern of the second fabric detected by the processing means while the second fabric is being held by the second fabric holding means.

22. The fabric position correcting device as claimed in claim 21, wherein the first and the second fabric holding means are disposed in vertically superposed relation with each other, and wherein the first and second imaging means are disposed in vertically superposed relation with each other.

23. A fabric position correcting device for correcting a position of at least one fabric lying in a horizontal XY plane comprising:

fabric holding means for holding at least a portion of a fabric, the fabric holding means being movable in X and Y directions in the XY plane and also angularly movable about a vertical axis so as to move the fabric to a desired position in the XY plane;

actuating means connected to the fabric holding means for moving the fabric holding means in the XY plane and angularly moving the fabric holding means about the vertical axis;

imaging means for imaging at least a portion of the fabric which is placed in a predetermined imaging range in the XY plane, the imaging means producing image signals;

memory means connected to the imaging means for storing image data converted form the image signals;

processing means for detecting an outer profile line of the fabric based on the image data retrieved from the memory means and computing an error distance in the X and Y directions and an error angle about a vertical axis extending from the detected outer profile line from a preset position; and control means connected to the actuating means for controlling the actuating means to feed the fabric to a desired final alignment position while correcting the position of the fabric until the error distance and the error angle computed by the processing means are eliminated, said control means operating such that the feeding and correcting are simultaneously performed while the fabric is being held by the fabric holding means.

24. The fabric position correcting device as claimed in claim 23, wherein the final alignment position is a stitched position defined at a bed of the sewing machine.

25. A fabric position correcting device for correcting a position of at least one fabric lying in a horizontal XY plane comprising:

fabric holding means for holding at lest a portion of a fabric, the fabric holding means being movable in X and Y directions in the XY plane and also angularly movable about a vertical axis so as to move the fabric to a desired position in the XY plane;

actuating means connected to the fabric holding means for moving the fabric holding means in the XY plane and angularly moving the fabric holding means about the vertical axis;

imaging means for imaging at least a portion of the fabric which is placed in a predetermine imaging range in the XY plane, the imaging means producing image signals;

memory means connected to the imaging means for storing image data converted from the image signals;

processing means for detecting an outer profile line of the fabric base don the image data retrieved from the memory means and computing an error distance in the X and Y directions and an error angle about a vertical axis extending from the detected outer profile line form a preset position; and control means connected to the actuating means for controlling the actuating means to correct the position of the fabric until the error distance and the error angle computed by the processing means are eliminated while the fabric is being held by the fabric holding means.

26. The fabric position correcting device as claimed in claim 25, wherein the fabric is fed in a feeding direction by the fabric holding means to a stitching position defined in a sewing machine, and wherein a fabric position correcting position is located upstream of the stitching position with respect to the feeding direction, the control means controlling the actuating means for the elimination of the error distance and error angle at the fabric position correcting position, and then controlling the actuating means for feeding the position-corrected fabric to the stitching position.

27. The fabric position correcting device as claimed in claim 25, wherein the fabric holding means comprise:

a support base horizontally extending in the Y direction;

at least one Y-direction movable base slidably movable along the support base and extending in the X direction;

at least one X-direction movable base slidably movable along the Y-direction movably base and extending in the Y direction;

at least one turn arm pivotally supported on the X-direction movable base, the turn arm being pivotally movable in the horizontal XY plane about the vertical axis and the fabric being held at the turn arm.

28. The fabric position correcting device as claimed in claim 27, wherein the turn arm comprises:

a turn arm body pivotally supported on the X-direction movable base;

a holder member lying in the horizontal XY plane and integrally connected to the turn arm body for supporting one surface of the fabric; and a holding member positioned in superposed relation to the holder member and pivotally movable in a vertical direction, the holding member being movably supported to the turn arm body for holding another surface of the fabric.

29. The fabric position correcting device a claimed in claim 28, wherein the actuating means comprises:

at least one first drive motor mounted to the support base for moving the Y-direction movable base in the Y direction;

at least one second drive motor mounted on the Y-direction movable base for moving the X-direction movable base in the X direction; and at least one third drive motor having a motor shaft, the third drive motor being mounted on the X-direction movable base for angularly rotating the turn arm about an axis of the motor shaft.

30. The fabric position correcting device as claimed in claim 29, wherein the actuating means further comprises a pneumatic cylinder connected to the control means and disposed between the turn arm body and the holding member for pivotally moving the holding member toward and away from the holder member, to thereby selectively hold the fabric between the holder member and the holding member.

31. The fabric position correcting device as claimed in claim 25, wherein the imaging means comprises at least one charge coupled device having a plurality of pixels for detecting density at the imaging area and generating the image signals.

32. The fabric position correcting device as claimed in claim 31, further comprising at least one A/D converter for converting the image signals into signals of the image data to be stored in the memory means.

33. The fabric position correcting device as claimed in claim 32, wherein the processing means comprises:

determination means for determining a proportion of an area of the fabric at the predetermined imaging range, and judging whether or not the proportion is greater than a predetermined value; and computing means for computing moving distance in at least on of X and Y direction and angular moving amount about the vertical axis with respect to a reference position.

34. The fabric position correcting device as claimed in claim 33, wherein the control means controls the actuating means for moving the fabric holding means by the computed distance and computed angle in accordance with a result of computation in the computing means.

35. The fabric position correcting device as claimed in claim 34, wherein the reference position serves as a stitched position taking a desired sewing margin into account.

36. The fabric position correcting device as claimed in claim 35, further comprising a support table for supporting the fabric in the horizontal XY plane, and wherein a sewing machine has a frame and a bed at which the stitched position is defined, the support base being supported on the frame, and the support table being positioned at a vertical level the same as that of the bed for feeding the fabric on the support table to the stitched position, the fabric holding means being moved for aligning the position of the fabric when the fabric holding means is positioned above the support table and the aligned fabric being fed to the stitched position.

37. The fabric position correcting device as claimed in claim 27, wherein the fabric holding means further comprises an auxiliary arm horizontally extending from the X direction movable base for supporting the imaging means.

38. The fabric position correcting device as claimed in claim 25, wherein the fabric holding means comprises:

a support member;

a first sewing arm having one end pivotally supported to the support member and having another end, the first sewing arm being pivotally movable in the horizontal XY plane;

a second sewing arm having one end pivotally supported to the other end of the first sewing arm and having another end, the second sewing arm being pivotally movable in the horizontal XY plane;

a turn arm having one end pivotally supported to the other end of the second sewing arm, the turn arm being pivotally movable in the horizontal XY plane about he vertical axis and the fabric being held at the turn arm.

39. The fabric position correcting device as claimed in claim 38, wherein the turn arm comprises:

a turn arm body pivotally supported to the other end of the sewing arm;

a holder member lying in the horizontal XY plane and integrally connected to the turn arm body for supporting one surface of the fabric; and a holding member positioned in superposed relation to the holder member and pivotally movable in a vertical direction, the holding member being movably supported to the turn arm body for holding another surface of the fabric.

40. The fabric position correcting device as claimed in claim 39, wherein the actuating means comprises:

a first drive motor supported on the support member and connected to the one end of the first sewing arm for angularly rotating the first sewing arm;

a second drive motor on the other end of the first sewing arm and connected to the one end of the second sewing arm for angularly rotating the second sewing arm; and a third drive motor mounted on the other end of the second sewing arm and connected to the turn arm body for angularly rotating the turn arm body.

41. The fabric position correcting device as claimed in claim 40, wherein the actuating means further comprises a pneumatic cylinder connected to the control means and disposed between he turn arm body and the holding member for pivotally moving the holding member toward and away from the holder member, to thereby selectively hold the fabric between the holder member and the holding member.

42. The fabric position correcting device as claimed in claim 41, further comprising a support table for supporting the fabric in the horizontal XY plane, and wherein a sewing machine has a frame and a bed at which a stitched position is defined, the support member being supported on the frame, and the support table being positioned at a vertical level the same as that of the bed for feeding the fabric on the support table to the stitched position, the fabric holding means being moved for aligning the position of the fabric when the fabric holding means is positioned above the support table and the aligned fabric being fed tot he stitched postions.

43. The fabric position adjusting device as claimed in claim 25, further comprising a selection means connected to the memory means for selecting one of detections to be carried in the processing means among the other profile line, the pattern and both the outer profile line and the pattern of the fabric.

44. The fabric position adjusting device as claimed in claim 43, wherein the processing means comprises:

detection means for detecting at least one of the outer profile line and a pattern of the fabric based on the image data retrieved from the memory means in accordance with a result of the selection by the selection means; and computing means for computing the error distance in the X and Y directions and an error angle about the vertical axis extending from the detected one of the outer profile line, the pattern, and the outer profile line and pattern.

45. The fabric position correcting device as claimed in claim 25, wherein the fabric includes first and second fabrics which lie in the horizontal XY plane in a superposed relation, and relative position of the first and second fabrics is to be controlled;

and wherein the holding means comprises first and second fabric hodlign means for holding at least portions of the first and second fabrics, respectively, the first and second fabric holding means being independently movable in X and Y direction in the XY plane and independently angularly movable about a vertical axis for respectively positioning the first and second fabrics to desired locations;

and wherein the actuating means comprises first and second actuating means connected to the first and second fabric holding means respectively for independently moving first and second fabric holding means in the XY plane and independently angularly moving the first and second fabric holding means about the vertical axis;

and wherein the imaging means comprises first and second imaging means for imaging at least portions of the first and second fabrics which are placed in first and second imaging ranges in the XY plane, the first and second imaging means producing respective independent image signals with respect to the portion of the first and second fabrics.

46. The fabric position correcting device as claimed in claim 45, wherein the memory means is connected to the first and second imaging means for storing image data converted form the image signals, and the processing means detecting at least one of the other profile lines and patterns of the first and second fabrics based on the image data retrieved from the memory means and computing an error distance in the X and Y directions and an error angle about the vertical axis extending from the detected one of the other profile line and the pattern of the first fabric from a preset position, and the control means controlling the first and second actuating means to correct relative postions of the first and second fabrics until the error distance and the error angle computed by the processing means are eliminated while the fabrics are being held by the first and second fabric holding means.

47. The fabric position correcting device as claimed in claim 46, wherein the control means comprises:

first control means for controlling the first actuating means to correct the position of the first fabric until the error distance and the error angle computed by the processing means are eliminated while the first fabric is being held by the first fabric holding means; and second control means for controlling the second actuating means to bring the second fabric into the preset position relative to the first fabric based on at least one of the outer profile line and the pattern of the second fabric detected by the processing means while the is being held by the second fabric holding means.

48. The fabric position correcting device as claimed in claim 47, wherein the first and the second fabric holding means are disposed in vertically superposed relation with each other, and wherein the first and second imaging means are disposed in vertically superposed relation with each other.

49. A fabric position correcting device for correcting a position of at least on fabric lying in a horizontal XY plane comprising:

fabric holding means for holding at least a portion of the fabric, the fabric holding means being movable in X and Y directions in the XY plane and also angularly movable about a vertical axis so as to move the fabric to a desired position in the XY plane;

actuating means connected to the fabric holding means for moving the fabric holding means in the XY plane and angularly moving the fabric holding means about the vertical axis;

imaging means for imaging at least a portion of the fabric which is placed in a predetermined imaging range in the XY plane, the imaging means producing image signals;

memory means connected to the imaging means for storing image data converted from the image signals;

processing means for detecting an outer profile line and a pattern of the fabric based on the image data retrieved from the memory means and computing an error distance in the X and Y directions and an error angle about a vertical axis extending from the detected outer profile line and the pattern from a preset position; and control means connected to the actuating means for controlling the actuating means to correct the position of the fabric until the error distance and the error angle computed by the processing means are eliminated while the fabric is being held by the fabric holding means.

50. The fabric position correcting device as claimed in claim 49, wherein the fabric is fed in a feeding direction by the fabric holding means to a stitching position defined in a sewing machine, and wherein a fabric position correcting position is located upstream of the stitching position with respect to the feeding direction, the control means controlling the actuating means for the eliminating of the error distance and error angle at the fabric potion correcting position, and then cotnrolling the actuating means for feeding the position-corrected fabric to the stitching position.

51. The fabric position correcting device as claimed in claim 49, wherein the fabric holding means comprises:

a support base horizontally extending in the Y directing;

at least one Y-direction movable base slidably movable along the support base and extending in the X direction;

at least on X-direction movable base slidably movable along the Y-direction movable base and extending in the Y direction;

a least on turn arm pivotally supported on the X-direction movable base, the turn arm being pivotally movable in the horizontal XY plane about the vertical axis and the fabric being held at the turn arm.

52. The fabric position correcting device as claimed in claim 51, wherein the turn arm comprises:

a turn arm body pivotally supported on the X-direction movable base;

a holder member lying in the horizontal XY plane and integrally connected to the turn arm body for supporting one surface of the fabric; and a holding member positioned in superposed relation to the holder member and pivotally movable in a vertical direction, the holding member being movably supported to the turn arm body for holding another surface of the fabric.

53. The fabric position correcting device as claimed in claim 52, wherein the actuating means comprises:

at least one first drive motor mounted to the support base for moving the Y-direction movable base in the Y direction;

at least one second drive motor mounted on the Y-direction movable base for moving the X-direction movable base in the X direction; and at lest one third drive motor having a motor shaft, the third drive motor being mounted on the X-direction movable base for angularly rotating the turn arm about an axis of the motor shaft.

54. The fabric position correcting device as claimed in claim 53, wherein the actuating means further comprises a pneumatic cylinder connected tot he control means and disposed between eh turn arm body and the hodlign member for pivotally moving the holding member toward and away from the holder member, to thereby selectively hold the fabric between the holder member and the holding member.

55. The fabric position correcting device as claimed in claim 49, wherein the imaging means comprises at least one charge coupled device having a plurality of pixels for detecting density at the imaging area and generating the image signals.

56. The fabric position correcting device as claimed in claim 55, further comprising at least one A/D converter for converting the image signals into signals of the image data to be stored in the memory means.

57. The fabric position correcting device as claimed in claim 56, wherein the processing means comprises:

determination means for determining a proportion of an area of the fabric at the predetermine imaging range, and judging whether or not the proportion is greater than a predetermined value; and computing means for computing moving distance in at least one of X and Y directions and angular moving amount about the vertical axis with respect to the reference position.

58. The fabric position correcting device as claimed in claim 57, wherein the control means controls the actuating means for moving the fabric holding means by the computed distance and computed angle in accordance with a result of computation in the computing means.

59. The fabric position correcting device as claimed in claim 58, wherein the reference position serves as a stitched position taking a desired sewing margin into account.

60. The fabric position correcting device as claimed in claim 59, further comprising a support table of supporting the fabric in the horizontal XY plane, and wherein a sewing machine has a frame and a bed at which the stitched position is defined, the support base being supported on the frame, and the support table being positioned at a vertical level the same as that of the bed for feeding the fabric on the support table to the stitched position, the fabric holding means being moved for aligning the position of the fabric when the fabric holding means is positioned above the support table and the aligned fabric being fed to the stitched postions.

61. The fabric position correcting device as claimed in claim 51, wherein the fabric holding means further comprises an auxiliary arm horizontally extending from the X direction movable base for supporting the imaging means.

62. The fabric position correcting device as claimed in claim 49, wherein the fabric holding means comprises:

a support member;

a first sewing arm having one end pivotally supported to the support member and having another end, the first sewing arm being pivotally movable in the horizontal XY plane;

a second sewing arm having one end pivotally supported to the other end of the first sewing arm and having another end, the second sewing arm being pivotally movable in the horizontal XY plane;

a turn arm having one end pivotally supported to the other end of the esecond sewing arm, the turn arm being pivotally movable in the horizontal XY plane about the vertical axis and the fabric being held at the turn arm.

63. The fabric position correcting device as claimed in claim 62, wherein the turn arm comprises:

a turn arm body pivotally supported to the other end of the sewing arm;

a holder member lying in the horizontal XY plane and integrally connected to the turn arm body for supporting one surface of the fabric; and a holding member positioned in superposed relation to the holder member and pivotally movable in a vertical direction, the holding member being movably supported to the turn arm body for holding another surface of the fabric.

64. The fabric position correcting device as claimed in claim 63, wherein the actuating means comprises:

a first drive motor supported on the support member and connected to the one end of the first sewing arm for angularly rotating the first sewing arm;

a second drive motor on the other end of the first sewing arm and connected to the one end of the second sewing arm for angularly rotating the second sewing arm; and a third drive motor mounted on the other end of the second sewing arm and connected to the turn arm body for angularly rotating the turn arm body.

65. The fabric position correcting device as claimed in claim 64, wherein the actuating means further comprises a pneumatic cylinder connected to the control means and disposed between the turn arm body and the holding member for pivotally moving the holding member toward and away from the holder member, to thereby selectively hold the fabric between the holder member and the holding member.

66. The fabric position correcting device as claimed in claim 65, further comprising a support table for supporting the fabric in the horizontal XY plane, and wherein a sewing machine has a frame and a bed at which a stitched position is defined, the support member being supported on the frame, and the support table being positioned at a vertical level the same as that of the bed for feeding the fabric on the support table to the stitched postions, the fabric holding means being moved for aligning the position of the fabric when the fabric holding means is positioned above the support table and the aligned fabric being fed tot he stitched postions.

67. The fabric position adjusting device as claimed in claim 49, further comprising a selection means connected to the memory means for selecting one of detections to be carried in the processing means among the outer profile line, the pattern and both the other profile line and the pattern of the fabric.

68. The fabric position adjusting device as claimed in claim 67, wherein the processing means comprises;

detection means for detecting at least one of the outer profile line and pattern of the fabric based on the image data retrieved from the memory means in accordance with a result of the selection by the selcton means; and computing means for computing the error distance in the X and Y directions and an error angle about the vertical axis of the detected one of the outer profile line, the pattern, and the other profile line and pattern.

69. The fabric position correcting device as claimed in claim 49, wherein the fabric includes first and second fabrics which lie in the horizontal XY plane in a superposed relation, and relative position of the first and second fabrics is to be controlled;

wherein the holding means comprises first and second fabric holding means for holding at least portions of the first and second fabrics, respectively, the first and second fabric holding means being independently movable in X and Y directions in the XY plane and independently angularly movable about a vertical axis for respectively positioning the first and second fabrics to desired locations;

and wherein the actuating means comprises first and second actuating means connected to the first and second fabric holding means respectively for independently moving first and second fabric holding means in the XY plane and independently angularly moving the first and second fabric holding means about the vertical axis;

and wherein the imaging means comprises first and second imaging means for imaging at least portions of the first and second fabrics which are placed in first and second imaging ranges in the XY plane, the first and second imaging means producing respective independent image signals with respect to the portions of the first and second fabrics.

70. The fabric position correcting device as claimed in claim 69, wherein the memory means is connected to the first and second imaging means for storing image data converted from the image signals, and the processing means detecting at least one of the outer profile lines and patterns of the first and second fabrics based on the image data received from the memory means and computing an error distance in the X and Y directions and an error angle about the vertical axis extending from the detected one of the outer profile line and the pattern of the first fabric from a preset postions, and the control means controlling the first and second actuating means to correct relative postions of the first and second fabrics until the error distance and the error angle computed by the processing means are eliminated while the fabrics are being held by the first and second fabric holding means.

71. The fabric position correcting device as claimed in claim 70, wherein the control mean comprises:

first control means for controlling the first actuating means to correct the position of the first fabric until the error distance and the error angle computed by the processing means are eliminated while the first fabric is being held by the first fabric holding means; and second control means for controlling the second actuating means to bring the second fabric into the preset position relative to the first fabric base on at least one of the outer profile line and the pattern of the second fabric detected by the processing means while the second fabric is being held by the second fabric holding means.

72. The fabric position correcting device as claimed in claim 71, wherein the first and the second fabric holding means are disposed in vertically superposed relation with each other, and wherein the first and second imaging means are disposed in vertically superposed relation with each other.

73. A fabric position correcting device for correcting a position of at least one fabric lying in a horizontal XY plane comprising:

fabric holding means for holding at least a portions of a fabric, the fabric holding means being movable in X and Y direction in the XY plane and also angularly movable about a vertical axis so as to move the fabric to a desired position in the XY plane;

actuating means connected to the fabric holding means for moving the fabric holding means in the XY plane and angularly moving the fabric holding means about the vertical axis;

imaging means for imaging at least a portion of the fabric which is placed in a predetermined imaging range in the XY plane, the imaging means producing image signals;

memory means connected to the imaging means for storing image data converted from the image signals;

processing means for detecting an outer profile line and a pattern of the fabric based on the image data retrieved from the memory means and computing an error distance in the X and Y directions and an error angle about a vertical axis extending from the detected outer profile line and the pattern form a preset position; and control means connected to the actuating means for controlling the actuating means to feed the fabric to a desired final alignment position while correcting the position of the fabric until the error distance and the error angle computed by the processing means are eliminated, said control means operating such that the feeding and correcting are simultaneously performed while the fabric is being held by the fabric holding means.

* * * * *